US011183752B2

(12) United States Patent
Huang et al.

(10) Patent No.: US 11,183,752 B2
(45) Date of Patent: Nov. 23, 2021

(54) ANTENNA STRUCTURE AND ANTENNA ARRAY

(71) Applicant: ETHETA COMMUNICATION TECHNOLOGY(SHENZHEN)CO.,LTD, Shenzhen (CN)

(72) Inventors: Huan-Chu Huang, Taoyuan (TW); Dasong Gao, Shenzhen (CN); Zhixing Qi, Shenzhen (CN); Hong Lin, Shenzhen (CN); Yanchao Zhou, Shenzhen (CN)

( * ) Notice: Subject to any disclaimer, the term of this patent is extended or adjusted under 35 U.S.C. 154(b) by 0 days.

(21) Appl. No.: 17/160,291

(22) Filed: Jan. 27, 2021

(65) Prior Publication Data

US 2021/0218134 A1 Jul. 15, 2021

(30) Foreign Application Priority Data

Jan. 16, 2021 (CN) ..... 202110058223.3

(51) Int. Cl.
*H01Q 1/36* (2006.01)
*H01Q 21/00* (2006.01)

(52) U.S. Cl.
CPC ..... *H01Q 1/36* (2013.01); *H01Q 21/0006* (2013.01)

(58) Field of Classification Search
CPC ..... H01Q 1/243; H01Q 1/36; H01Q 1/48; H01Q 1/24–48
See application file for complete search history.

(56) References Cited

U.S. PATENT DOCUMENTS 6,456,249 B1 * 9/2002 Johnson ..... H01Q 1/243 343/700 MS
7,289,068 B2 * 10/2007 Fujio ..... H01Q 9/0407 343/700 MS
9,190,733 B2 * 11/2015 Desclos ..... H01Q 5/321
2005/0280579 A1 12/2005 Liang et al.
2012/0001803 A1 * 1/2012 Shau ..... H01Q 9/0421 343/700 MS
2014/0184464 A1 7/2014 Ilnar et al.
2014/0266919 A1 9/2014 Chen
2019/0356045 A1 * 11/2019 Yu ..... H01Q 1/243

* cited by examiner

*Primary Examiner* — Hasan Islam

(57) ABSTRACT

The embodiment of the present disclosure provides an antenna structure and an antenna array. The antenna structure comprises a first antenna component which comprises: a first three-dimensional antenna with one end grounded or connected with a reference potential; a single antenna port connected with the other end of the first three-dimensional antenna; and a first parasitic structure provided adjacent to the first three-dimensional antenna. In the antenna structure, the first three-dimensional antenna is only connected with a single antenna port, so that the number of ports required by the antenna can be reduced, that is, the power consumption can be reduced from the antenna dimension, thereby simultaneously reducing heat generation and maintaining stable overall wireless performance.

10 Claims, 27 Drawing Sheets

10

ANTENNA STRUCTURE AND ANTENNA ARRAY

TECHNICAL FIELD

The present disclosure relates to the technical field of antennas, in particular to an antenna structure and an antenna array.

BACKGROUND

Nowadays, we have entered the age of 5G (the fifth generation mobile communication), and 5G communication is classified into millimeter wave band segment and non-millimeter wave band segment. There are many different frequency bands in millimeter wave band segment, so that the broadband or multi-frequency millimeter wave antenna is the mainstream demand. The existing broadband millimeter wave antenna is generally of a multi-port structure (i.e. more than one port), so that its power consumption and heat generation are high, which is unfavorable to the power consumption of the whole system and the stability of the whole wireless performance, and further affects user experience and product comprehensive competitiveness.

SUMMARY

In view of this, it is necessary to provide an antenna structure and antenna array to improve the above problems.

In a first aspect, an embodiment of the present disclosure provides an antenna structure, wherein the antenna structure comprises a first antenna component, which comprises:

- a first three-dimensional antenna with one end grounded or connected with a reference potential;
- a single antenna port connected with the other end of the first three-dimensional antenna; and
- a first parasitic structure provided adjacent to the first three-dimensional antenna.

In the antenna structure provided by the embodiment of the present disclosure, the first three-dimensional antenna is only connected with a single antenna port, so that the number of ports required by the antenna can be reduced (only based on a single port), that is, the power consumption is reduced from the antenna dimension, thereby simultaneously reducing heat generation and maintaining stable overall wireless performance. One end of the first three-dimensional antenna is grounded or connected with a reference potential, so that the antenna structure can enhance antenna performance (e.g., larger bandwidth coverage, higher antenna efficiency, better radiation polarization performance, or better radiation pattern, etc.). At the same time, through the first parasitic structure provided adjacent to the first three-dimensional antenna, the first antenna component is also beneficial to covering multi-frequency and broadband bands (such as multi-frequency and broadband 5G millimeter wave bands), thereby significantly improving user experience and product comprehensive competitiveness.

Further, in some embodiments, the first three-dimensional antenna comprises an antenna main body and a feeding part, wherein at least part of the antenna main body is located in a first plane, at least part of the feeding part is located in a second plane different from the first plane, and the feeding part is connected between the antenna main body and the single antenna port. It can be understood that the feeding part is connected between the antenna main body and the single antenna port, which can realize the antenna feeding function. The feeding part and the antenna main body are located on different planes, which can form a three-dimensional antenna structure, so that the antenna has the advantages of farther ground height, more freedom in design and optimization, better antenna performance, reduced antenna horizontal area and the like.

Further, in some embodiments, the first three-dimensional antenna further comprises a bending part, the bending part is connected with the antenna main body, and at least part of the bending part and the antenna main body are located in different planes. One end of the bending part is connected with the antenna main body, and the other end thereof is grounded, floated or connected with a reference potential. The bending part is connected with one end of the antenna main body far away from the feeding part. The number of the bending parts is at least two. The antenna main body comprises a first connecting part connected with the feeding part, a second connecting part connected with the bending part, and a main body part connected between the first connecting part and the second connecting part, and there are a plurality of bending parts which are connected with the second connecting part, respectively. It can be understood that through the bending part, the antenna structure also has higher degree of freedom in design and optimization, enhances antenna performance to meet different design requirements, and has higher opportunities to improve manufacturability and reduce the size of the antenna structure.

Further, in some embodiments, the antenna structure further comprises an auxiliary antenna part, and the auxiliary antenna part and the antenna main body are stacked and floated. The auxiliary antenna part can increase the tuning freedom of the antenna structure, enhance the antenna performance and reduce the volume.

Further, in some embodiments, the first three-dimensional antenna further comprises a first extending part and/or a second extending part, the first extending part is connected with the feeding part, and the second extending part is connected with the bending part. The first extending part and/or the second extending part can also increase the tuning freedom of the antenna structure, enhance the antenna performance and reduce the volume.

Further, in some embodiments, the first parasitic structure is an axisymmetric figure with an axis of symmetry in the extending direction of the antenna main body. The first parasitic structure is an isosceles triangle, an isosceles trapezoid or a pentagon formed by aligning and connecting the lower bottoms of two identical right-angled trapezoids. It can be understood that by designing the shape of the first parasitic structure, the first antenna component has higher degree of freedom in design and optimization, enhances antenna performance to meet different design requirements, and is conformally compatible with the metal wall and/or metal frame around the first antenna component, and has higher opportunities to improve manufacturability and reduce the size of the antenna structure.

Further, in some embodiments, the number of the first parasitic structures is at least one, and at least one of the first parasitic structures is adjacent to one end of the antenna main body connected with the feeding part and/or one end of the antenna main body far away from the feeding part. It can be understood that using a first parasitic structure is beneficial to reducing the complexity and cost of antenna manufacturing.

Further, in some embodiments, the number of the first parasitic structures comprises two, wherein one of the first parasitic structures is adjacent to one end of the antenna main body connected with the feeding part, and the other of the first parasitic structures is adjacent to one end of the antenna main body far away from the feeding part. Two of the first parasitic structures are symmetrically provided in the direction perpendicular to the extending direction of the antenna main body. It can be understood that using two first parasitic structures is beneficial to achieving a better multi-frequency and broadband effect, and has better antenna performance (e.g., larger bandwidth coverage, higher antenna efficiency, better radiation polarization performance, or better radiation pattern, etc.), thereby improving user experience and product comprehensive competitiveness.

Further, in some embodiments, the first parasitic structure is located in the first plane or other planes parallel to the first plane. The first parasitic structure has a higher degree of freedom in design and optimization, which is beneficial to achieving a better multi-frequency and broadband effect and better antenna performance, and improving user experience and product comprehensive competitiveness.

Further, in some embodiments, the number of the first parasitic structures is at least two, at least two of the first parasitic structures are arranged in sequence in the direction perpendicular to the first plane, and the shapes of at least two of the first parasitic structures are the same or different. It can be understood that through the first parasitic structure, the first antenna component has higher degree of freedom in design and optimization, enhances antenna performance to meet different design requirements, and has higher opportunities to improve manufacturability and reduce the size of the antenna structure.

Further, the antenna structure comprises a carrier, the single antenna port is provided on the carrier, and the first parasitic structure and the first three-dimensional antenna are located on the same side of the carrier. It can be understood that the carrier can provide an effective carrier for a single antenna port and the first three-dimensional antenna, which is beneficial to improving the stability, manufacturability, wear resistance of antenna performance and having better antenna performance, and has the advantages of reducing the size of the antenna structure and the like.

Further, in some embodiments, a reference ground layer is further provided on the carrier, and the first parasitic structure is further electrically connected with the reference ground layer. It can be understood that through the reference ground layer, the first antenna component also has better antenna performance and higher degree of freedom in design and optimization.

Further, in some embodiments, the antenna structure further comprises a filling medium provided on the carrier, at least part of the filling medium is located on the same side of the carrier as the first parasitic structure and the first three-dimensional antenna, at least part of the feeding part is located in the filling medium, at least part of the antenna main body is located in the filling medium or the antenna main body is located at one side of the filling medium far away from the carrier, and at least part of the first parasitic structure is located in the filling medium or at one side of the filling medium far away from the carrier. It can be understood that the filling medium can not only ensure the performance of the antenna structure, but also provide support for the first three-dimensional antenna and the first parasitic structure. The stability, manufacturability, damage resistance, and confidentiality of the performance of the first antenna component can be enhanced, and it has the advantages of reducing the size of the antenna structure.

Further, in some embodiments, the antenna structure further comprises a metal wall provided on the outer side of the filling medium and/or a metal fence provided in the filling medium and adjacent to the outer side of the filling medium. It can be understood that the metal wall and/or the metal fence is beneficial to improving the interference resistance to the antenna performance caused by the change of the surrounding environment of the antenna, that is, it can guarantee the stability of the antenna performance.

Further, in some embodiments, the antenna main body is located at one side of the filling medium far away from the carrier. It can be understood that the antenna main body is located on the side of the filling medium far away from the carrier, and the above design method is beneficial to reducing the manufacturing complexity. For example, the antenna main body can be directly formed or provided on the filling medium to achieve better antenna performance.

Further, in some embodiments, the surface of the filling medium far away from the carrier further comprises a groove, and the antenna main body is located in the groove. It can be understood that the groove can increase tunability, so that the first antenna component has higher degree of freedom in design and optimization, enhances antenna performance to meet different design requirements, and has higher opportunities to improve manufacturability and reduce the size of the antenna structure.

Further, in some embodiments, the antenna structure further comprises a second antenna component, the first antenna component has the same structure as the second antenna component, and the antenna main body of the first antenna component and the antenna main body of the second antenna component are provided orthogonally, so that the antenna structure constitutes a dual-polarized antenna structure. It can be understood that dual-polarized radiation can be formed by the first antenna component and the second antenna component which are orthogonally provided on the antenna main body, so that based on polarization diversity, the probability of the problems, e.g., disconnection of wireless connection or weak signal reception can be reduced, and the function of Multiple-Input Multiple-Output (MIMO) can be achieved, so as to enhance the transmission rate and improve user experience and product competitiveness again. It can be understood that the same structure of the first antenna component and the second antenna component mainly means that the components of the first antenna component and the second antenna component are basically the same, such as comprising the first three-dimensional antenna with one end grounded, the single antenna port connected with the other end of the first three-dimensional antenna, and the first parasitic structure provided adjacent to the first three-dimensional antenna. The first three-dimensional antenna comprises the antenna main body, the feeding part and the bending part. At least part of the antenna main body is located in a first plane, at least part of the feeding part is located in a second plane different from the first plane, and the feeding part is connected between the antenna main body and the single antenna port. The bending part is connected with one end of the antenna main body far away from the feeding part, and at least part of the bending part and the antenna main body are located in different planes, and the bending part is grounded. However, the positions of the elements in the first antenna component and the second antenna component can be set as required. For example, the first antenna component and the second antenna component involved in these embodiments are orthogonally provided, which will result in different extending directions and positions of the antenna main bodies, but will not affect their basically identical elements.

Further, in some embodiments, the plane where the antenna main body of the first antenna component is located is parallel to the plane where the antenna main body of the second antenna component is located, the projection of the antenna main body of the first antenna component intersects with the projection of the antenna main body of the second antenna component when viewed in the direction perpendicular to the plane where the antenna main body is located; the first parasitic structure of the first antenna component and the first parasitic structure of the second antenna component are located in the same plane or the plane where the first parasitic structure of the first antenna component is located is parallel to the plane where the first parasitic structure of the second antenna component is located. It can be understood that the first antenna component and the second antenna component with the above structure realizes dual-polarized radiation, and at the same time, is beneficial to reducing manufacturing complexity and improving product competitiveness.

Further, in some embodiments, the antenna main body of the second antenna component comprises two main body parts and a bending part, the two main body parts are located on the same plane as the antenna main body of the first antenna component and are located at two sides of the antenna main body of the first antenna component, respectively, and the bending part wraps around the outside of the antenna component of the first antenna component and connects the two main body parts. It can be understood that the first antenna component and the second antenna component with the above structure are beneficial to achieving the antenna performance of dual-polarized radiation, thereby further improving user experience and product competitiveness.

Further, in some embodiments, the first antenna component further comprises at least one parasitic connecting part, one end of which is connected with the first parasitic structure, and the other end of which is grounded, floated or connected with a reference potential. It can be understood that through at least one parasitic connecting part, the first antenna component has higher degree of freedom in design and optimization, enhances antenna performance to meet different design requirements, and has higher opportunities to improve manufacturability and reduce the size of the antenna structure.

Further, in some embodiments, the first antenna component further comprises at least one second parasitic structure, and the second parasitic structure is connected with the parasitic connecting part. It can be understood that through the second parasitic structure, the first antenna component has higher degree of freedom in design and optimization, enhances antenna performance to meet different design requirements, and has higher opportunities to improve manufacturability and reduce the size of the antenna structure. Especially, when the second parasitic structure is applied to the dual-polarized antenna structure, both the first antenna component and the second antenna component can have higher degree of freedom in design and optimization and enhance antenna performance to meet different design requirements.

In a second aspect, an embodiment of the present disclosure further provides an antenna array, which comprises at least two antenna structures described in any one of the above embodiments.

In the antenna array provided by the embodiment of the present disclosure, at least two antenna structures are combined into the antenna array, so that better antenna gain can be obtained, so as to compensate for propagation path loss, increase the radiation distance of energy, and realize the function of beam scanning, in order to achieve wider beam coverage. Furthermore, when the antenna structure is a dual-polarized antenna structure, polarization mismatch of wireless transmission can be further reduced and Multiple-Input and Multiple-Output (MIMO) function can be achieved, so as to improve the data rate and achieve better user wireless experience and product competitiveness.

BRIEF DESCRIPTION OF THE DRAWINGS

In order to explain the technical scheme in the embodiments of the present disclosure more clearly, the drawings used in the embodiments will be briefly introduced hereinafter. Obviously, the drawings in the following description are only some embodiments of the present disclosure, and for those skilled in the art, other drawings can be obtained according to these drawings without paying creative labor.

DESCRIPTION OF THE EMBODIMENTS

Figure 1:
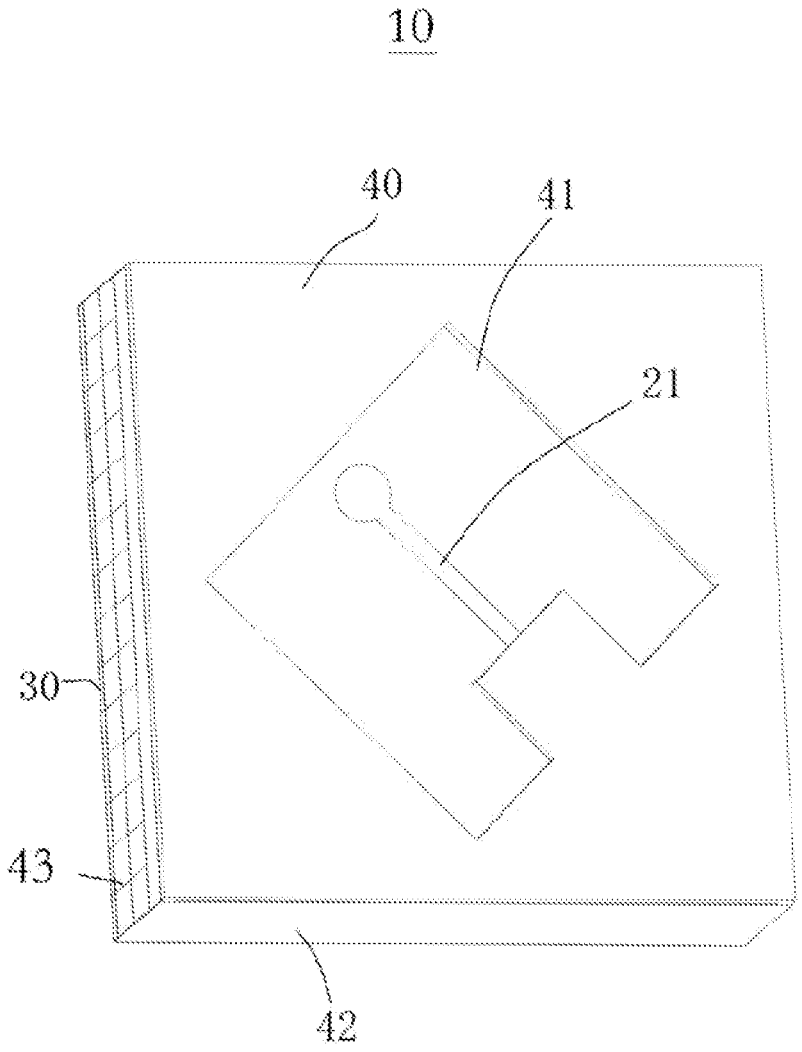
FIG. 1 is a perspective diagram of an antenna structure according to Embodiment 1 of the present disclosure.

In the following, the technical scheme in the embodiments of the present disclosure will be described clearly and completely with reference to the drawings in the embodiments of the present disclosure. Obviously, the described embodiments are only some embodiments of the present disclosure, rather than all of the embodiments. Based on the embodiments of the present disclosure, all other embodiments obtained by those skilled in the art without paying creative labor belong to the scope of protection of the present disclosure.

In the present disclosure, the orientation or positional relationship indicated by the terms "upper", "lower", "left", "right", "front", "rear", "top", "bottom", "inner", "outer", "middle", "vertical", "horizontal", "lateral" and "longitudinal" is based on the orientation or positional relationship shown in the drawings. These terms are mainly used to better describe the present disclosure and its embodiments, but are not used to define that the indicated devices, elements or components must have a specific orientation, or be constructed and operated in a specific orientation.

Furthermore, some of the above terms can be used not only to express the orientation or positional relationship, but also to express other meaning. For example, the term "upper" may also be used to express a certain dependency or connection relationship in some cases. For those skilled in the art, the specific meanings of these terms in the present disclosure can be understood according to specific situations.

In addition, the terms "install", "provide", "provided with", "connect" and "link" should be understood in a broad sense. For example, it can be fixedly connected, detachably connected, or integrally constructed; it can be mechanically connected or electrically connected; it can be directly connected, indirectly connected through an intermediate medium, or internally communicated between two devices, elements or components. For those skilled in the art, the specific meanings of the above terms in the present disclosure can be understood according to specific situations.

In addition, the terms "first", "second", etc. are mainly used to distinguish different devices, elements or components (the specific types and configurations may be the same or different), but are not used to indicate or imply the relative importance and quantity of the indicated devices, elements or components. Unless otherwise specified, "a plurality of" means two or more.

Embodiment 1

Figure 2:
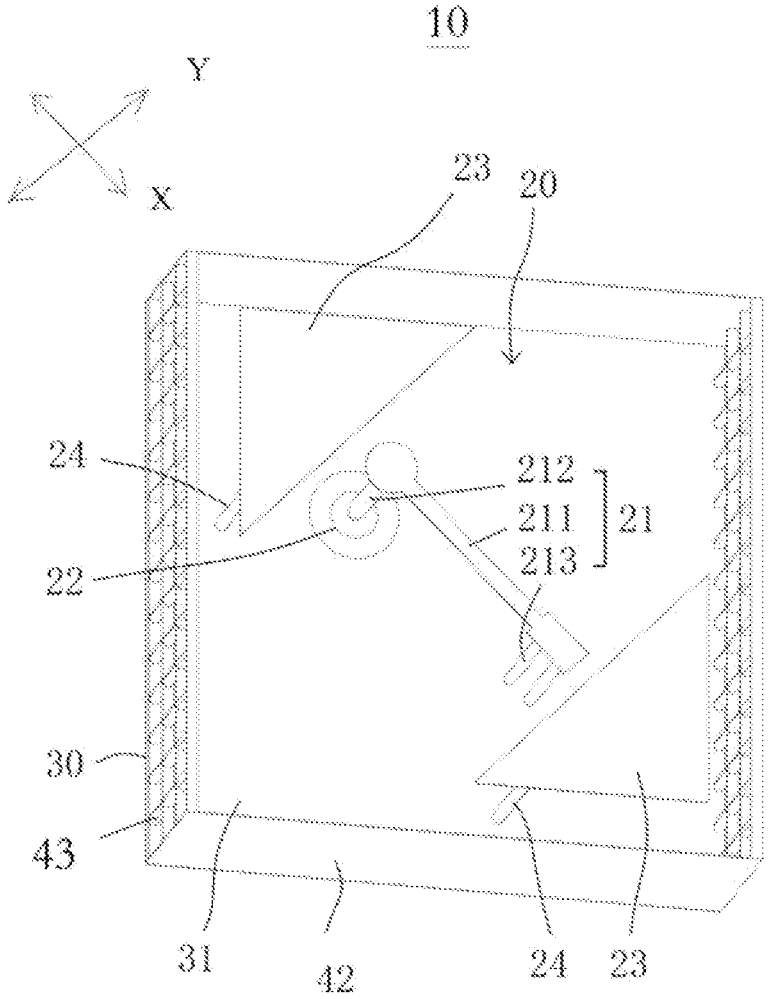
FIG. 2 is a perspective diagram of an antenna structure shown in FIG. 1 with the filling medium hidden.
Figure 3:
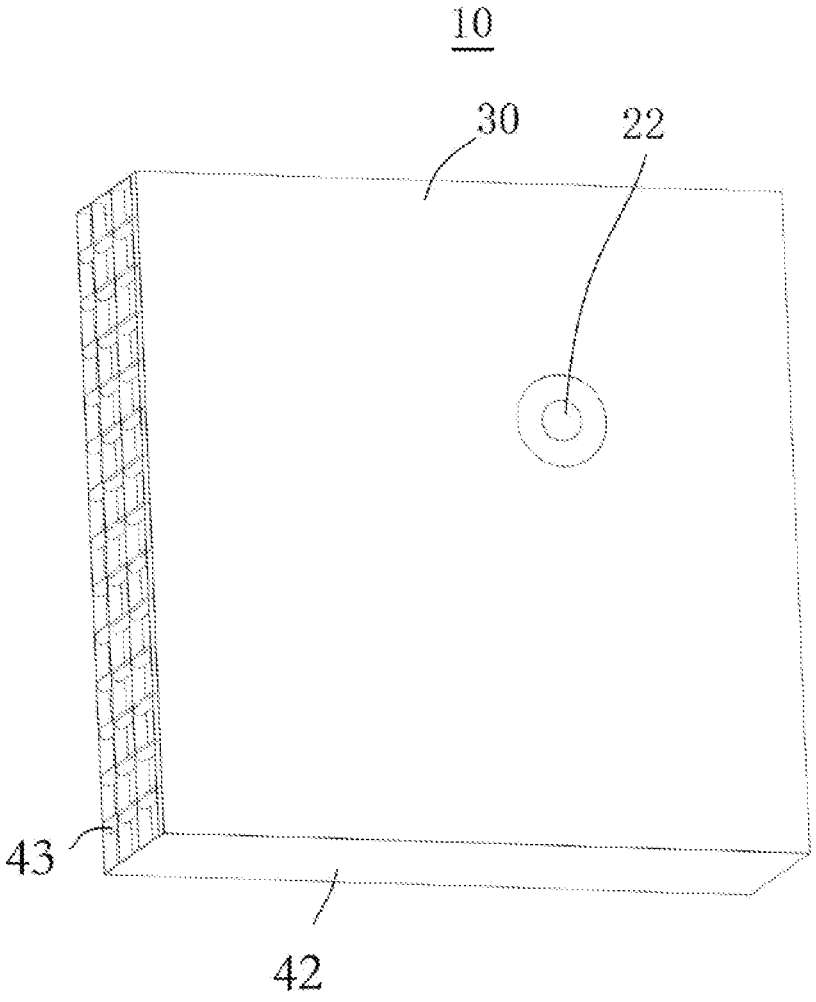
FIG. 3 is a perspective diagram of an antenna structure shown in FIG. 2 from another angle with the filling medium hidden.

Refer to FIG. 1, FIG. 2 and FIG. 3. FIG. 1 is a perspective diagram of an antenna structure 10 according to Embodiment 1 of the present disclosure, FIG. 2 is a perspective diagram of an antenna structure shown in FIG. 1 with the filling medium hidden, and FIG. 3 is a perspective diagram of an antenna structure shown in FIG. 2 with the filling medium hidden from another angle. The antenna structure 10 comprises a first antenna component 20, a carrier 30 and a filling medium 40. The first antenna component 20 is provided on the carrier 30, and the filling medium 40 is provided on the carrier 30 and covers at least part of the first antenna component 20.

The first antenna component 20 comprises a first three-dimensional antenna 21 with one end grounded or connected with a reference potential, a single antenna port 22 connected with the other end of the first three-dimensional antenna 21, and a first parasitic structure 23 provided adjacent to the first three-dimensional antenna 21. It can be understood that the first three-dimensional antenna 21 is a conductor. The first three-dimensional antenna has one polarization direction and is only connected with the single antenna port 22 to reduce heat generation. The first parasitic structure 23 is also a conductor, and is provided adjacent to the first three-dimensional antenna 21, so as to broaden the frequency band, so that the first antenna component 20 can cover multi-frequency and broadband bands (such as multi-frequency and broadband 5G millimeter bands), and achieve a multi-frequency and broadband effect. It can be understood that the reference potential may be other fixed potentials than the ground potential.

In the antenna structure 10 provided by the embodiment of the present disclosure, the first three-dimensional antenna 21 is only connected with a single antenna port 22, so that the number of ports required by the antenna can be reduced (only based on a single port), that is, the power consumption is reduced from the antenna dimension, thereby simultaneously reducing heat generation and maintaining stable overall wireless performance. One end of the first three-dimensional antenna 21 is grounded, so that the antenna structure 10 has better antenna performance. At the same time, through the first parasitic structure 23 provided adjacent to the first three-dimensional antenna 21, the first antenna component 20 is also beneficial to covering multi-frequency and broadband bands (such as multi-frequency and broadband 5G millimeter wave bands), thereby significantly improving user experience and product comprehensive competitiveness.

The single antenna port 22 may be provided on the carrier 30. Specifically, the single antenna port 22 may penetrate through the carrier 30, so that one end of the single antenna port 22 is exposed from one side of the carrier 30, and the other end of the single antenna port 22 is connected with the first three-dimensional antenna 21 located on the other side. It can be understood that the first parasitic structure 23 can also be provided on the carrier 30. The first parasitic structure 23 and the first three-dimensional antenna 21 are located on the same side of the carrier 30, but are not limited thereto. The carrier 30 can provide an effective carrier for the single antenna port 22, the first parasitic structure 23 and the first three-dimensional antenna 21, which is beneficial to improving the stability, manufacturability, wear resistance of antenna performance and having better antenna performance, and has the advantages of reducing the size of the antenna structure 10 and the like.

The first three-dimensional antenna 21 comprises an antenna main body 211, a feeding part 212 and a bending part 213. The antenna main body 211, the feeding part 212 and the bending part 213 can all be made of the same conductor material. In some embodiments, the feeding part 212 and the bending part 213 may be conductive pillars formed in the filling medium 40.

Specifically, at least part of the antenna main body 211 is located in a first plane, and at least part of the feeding part 212 is located in a second plane different from the first plane, and the feeding part 212 is connected between the antenna main body 211 and the single antenna port 22. It can be understood that the feeding part 212 is connected between the antenna main body 211 and the single antenna port 22, which can realize the antenna feeding function. The feeding part 212 and the antenna main body 211 are located on different planes, which can form a three-dimensional antenna structure, so that the antenna has the advantages of farther ground height, more freedom in design and optimization, better antenna performance, reduced antenna horizontal area and the like.

The bending part 213 is connected with the antenna main body 211, and at least part of the bending part 213 and the antenna main body 211 are located in different planes. One end of the bending part 213 is grounded or connected with a reference potential. In this embodiment, the bending part 213 can be grounded. The bending part 213 is connected with an end of the antenna main body 211 far away from the feeding part 212. In this embodiment, the number of the bending parts 213 is two, and the two bending parts 213 are connected with the antenna main body 211, respectively. It can be understood that through the bending part 213, the antenna structure 10 also has higher degree of freedom in design and optimization, enhances antenna performance to meet different design requirements, and has higher opportunities to improve manufacturability and reduce the size of the antenna structure 10.

The first parasitic structure 23 may be an axisymmetric figure with an axis of symmetry in the extending direction x of the antenna main body 211. Specifically, the first parasitic structure 23 is an isosceles triangle, an isosceles trapezoid or a pentagon formed by aligning and connecting the lower bottoms of two identical right-angled trapezoids, but it is not limited thereto. In this embodiment, the first parasitic structure 23 is mainly described as an isosceles triangle as an example. It can be understood that by designing the shape of the first parasitic structure 23, the first antenna component 20 has higher degree of freedom in design and optimization, enhances antenna performance to meet different design requirements, and is conformally compatible with the metal wall 42 and/or metal frame 43 around the first antenna component 10, and has higher opportunities to improve manufacturability and reduce the size of the antenna structure 10. In other words, the shape of the first parasitic structure 23 is designed to adapt to the shape of the metal wall 42 and/or the metal frame 43 on the periphery, which is beneficial to reducing the size of the antenna structure 10.

The number of the first parasitic structures 23 may be at least one, and at least one of the first parasitic structures 23 may be adjacent to one end of the antenna main body 211 connected with the feeding part 212 and/or one end of the antenna main body 211 far away from the feeding part 212. In this embodiment, the number of the first parasitic structures 23 is two, which is mainly illustrated as an example. Two of the first parasitic structures 23 may be symmetrically provided in the direction Y perpendicular to the extending direction X of the antenna main body 211. It can be understood that using two first parasitic structures 23 is beneficial to achieving a better multi-frequency and broadband effect, and has better antenna performance, thereby improving user experience and product comprehensive competitiveness.

Specifically, among the two first parasitic structures 23, one of the first parasitic structures 23 is connected with one end of the feeding part 212 adjacent to the antenna main body 211, the bottom of the isosceles triangle of the first parasitic structure 23 may be perpendicular to the extending direction X of the antenna main body 211 and provided adjacent to the feeding part 212, and the apex angle of the isosceles triangle of the first parasitic structure 23 may be located at one end of the first parasitic structures 23 far away from the feeding part 212. The other of the first parasitic structures 23 is adjacent to an end of the antenna main body 211 far away from the feeding part 212 (e.g., an end of the antenna main body 211 connected with the bending part 213), the bottom of the isosceles triangle of the first parasitic structure 23 may be perpendicular to the extending direction X of the antenna main body 211 and provided adjacent to the bending part 213, and the apex angle of the isosceles triangle of the first parasitic structure 23 may be located at one end of the first parasitic structures 23 far away from the bending part 213.

The first antenna component 20 further comprises at least one parasitic connecting part 24, one end of which is connected with the first parasitic structure 23, and the other end of which can be grounded, floated or connected with a reference potential. It can be understood that through at least one parasitic connecting part 24, the first antenna component 20 has higher degree of freedom in design and optimization, enhances antenna performance to meet different design requirements, and has higher opportunities to improve manufacturability and reduce the size of the antenna structure.

The first parasitic structure 23 can be grounded, floated or connected with a reference potential. In this embodiment, a reference ground layer 31 can be provided on the carrier 30, and the first parasitic structure 23 and the bending part 213 of the first three-dimensional antenna 21 can be electrically connected with the reference ground layer 31. It can be understood that the reference ground layer 31 can be a ground potential or other reference potential. Through the reference ground layer 31, the first antenna component 20 also has better antenna performance and higher degree of freedom in design and optimization. In this embodiment, the first parasitic structure 23 is electrically connected with the reference ground layer 31 through at least one parasitic connection 24. The parasitic connection 24 may be a conductive pillar formed in the filling medium 40.

In addition, in this embodiment, the first parasitic structure 23 can be located in the first plane where the antenna main body 211 is located, that is, the first parasitic structure 23 and the antenna main body 211 are located in the same plane. The plane where the first parasitic structure 23 and the antenna main body 211 are located may be parallel to the plane of the carrier 30 adjacent to the first parasitic structure 23 and the antenna main body 211, that is, parallel to the reference ground layer 31. The first parasitic structure 23 coplanar with the antenna main body 211 is beneficial to improving the freedom in design and optimization, which is beneficial to achieving a better multi-frequency and broadband effect and better antenna performance, and improving user experience and product comprehensive competitiveness. In addition, the above design of the first parasitic structure 23 and the antenna main body 211 parallel to the surface of the carrier 30 can also increase tunability, so that the first antenna component 20 has higher degree of freedom in design and optimization, enhances antenna performance to meet different design requirements, has better antenna performance, and has higher opportunities to improve manufacturability and reduce the size of the antenna structure.

Further, the surface of the filling medium 40 far away from the carrier 30 further comprises a groove 41, which can be a special groove. The specific shape can be designed according to actual needs. At least part of the antenna main body 211 is located in the groove 41, and the feeding part 212 and the bending part 213 can both be covered by the filling medium 40. It can be understood that the groove 41 can increase tunability, so that the first antenna component 20 has higher degree of freedom in design and optimization, enhances antenna performance to meet different design requirements, and has higher opportunities to improve manufacturability and reduce the size of the antenna structure.

The antenna structure 10 further comprises a metal wall 42 and/or a metal fence 43 provided on the outer side of the filling medium 40. Specifically, the metal wall 42 can be provided on the carrier 30 by the filling medium 40, and its material can be selected according to actual needs, including but not limited to air, ceramics (such as low temperature co-fired ceramics LTCC), boards, etc. It can be understood that the filling medium 40 can be made of the same material as the carrier 30, or different materials, which can be designed according to actual needs. At least part of the filling medium 40 is located on the same side of the carrier 30 as the first parasitic structure 23 and the first three-dimensional antenna 21. The feeding part 212 can be located in the filling medium 40, and the antenna main body 211 can be located on the side of the filling medium 40 far away from the carrier 30. It can be understood that the filling medium 40 can not only achieve better antenna performance, but also provide support for the first three-dimensional antenna 21 and the first parasitic structure 23. The stability, manufacturability, damage resistance, and confidentiality of the first antenna component 20 can be enhanced with better confidentiality.

The antenna structure 10 further comprises a metal wall 42 provided on the outer side of the filling medium 40 and/or a metal fence 43 provided in the filling medium 40 and adjacent to the outer side of the filling medium 40. Specifically, a metal layer formed by painting or printing a conductive material on the outer side of the filling medium 40 may also have a shell structure such as a metal sheet. The metal fence 43 can be formed in the filling medium 40 or formed by splicing a plurality of metal strips. It can be understood that the metal wall 42 and/or the metal fence 43 is beneficial to improving the interference resistance to the antenna performance caused by the change of the surrounding environment of the antenna, that is, it can guarantee the stability of the antenna performance.

Figure 4:
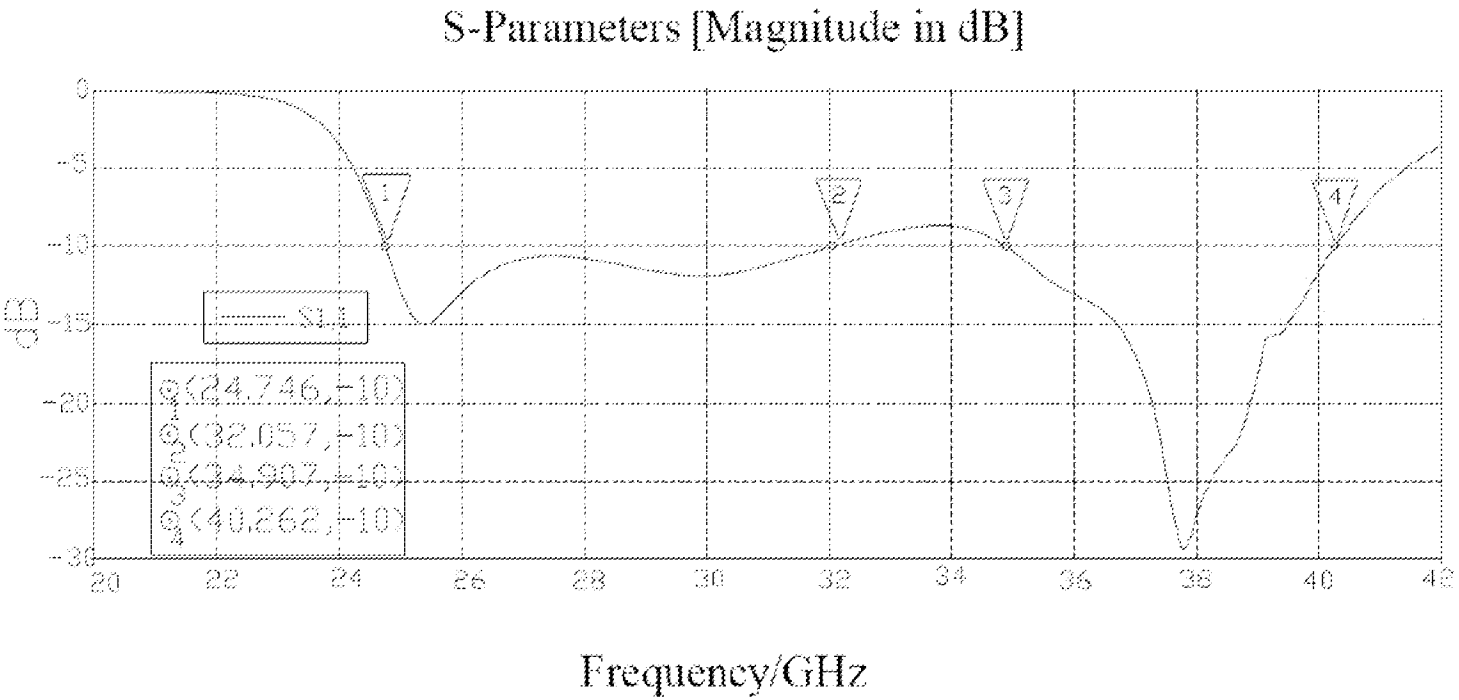
FIG. 4 is an antenna impedance bandwidth performance diagram of an antenna structure shown in FIG. 1.

Further, as shown in FIG. 4, it can be seen from the antenna impedance bandwidth performance diagram of an antenna structure 10 according to Embodiment 1 that the antenna structure 10 can achieve multi-frequency and broadband coverage based on the feeding of a single antenna port 22, which significantly improves user experience and product comprehensive competitiveness.

Embodiment 2

Figure 5:
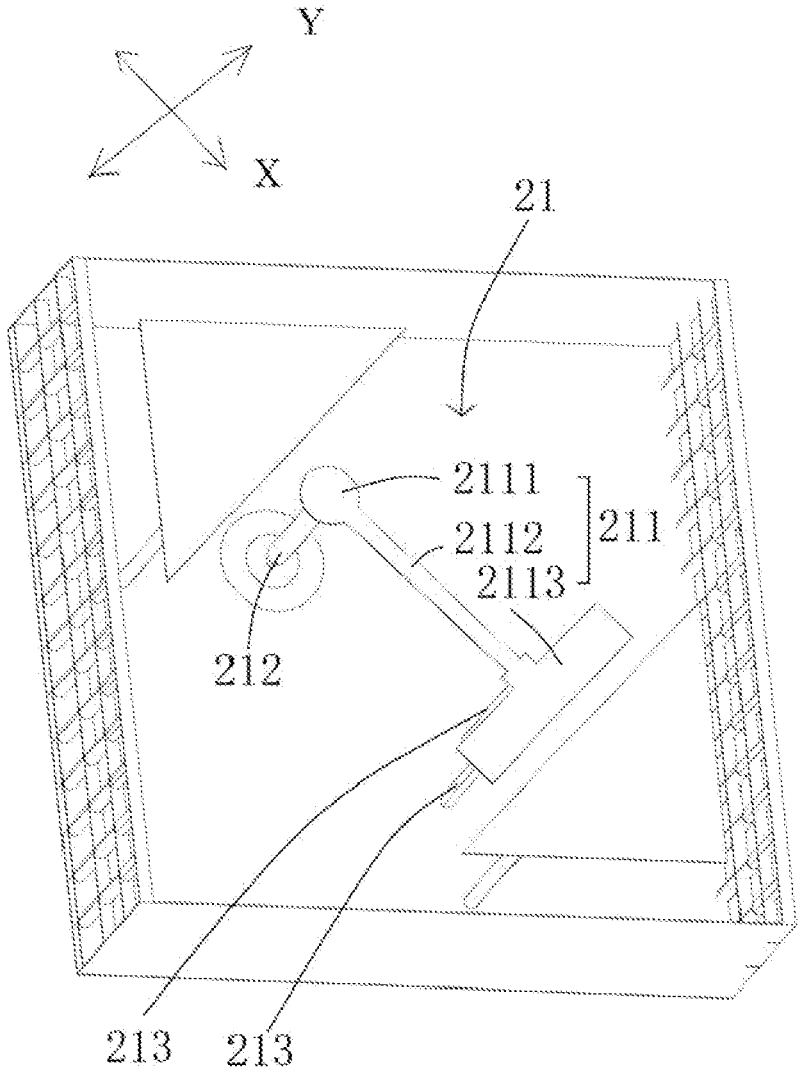
FIG. 5 is a perspective diagram of an antenna structure according to Embodiment 2 of the present disclosure with the filling medium hidden.

Refer to FIG. 5, which is a perspective diagram of an antenna structure 10 according to Embodiment 2 of the present disclosure with the filling medium hidden. The antenna structure 10 in Embodiment 2 is basically the same as the antenna structure 10 in Embodiment 1. That is, the above description of the antenna structure 10 in Embodiment 1 can be basically applicable to the antenna structure 10 in Embodiment 2. The differences between the antenna structure 10 in Embodiment 2 and the antenna structure 10 in Embodiment 1 will be mainly described hereinafter.

In Embodiment 2, the antenna main body 211 comprises a first connecting part 2111 connected with the feeding part 212, a second connecting part 2112 connected with the bending part 213, and a main body part 2113 connected between the first connecting part 2111 and the second connecting part 2112. The main body 2113 extends in the direction X, and the second connecting part 2112 extends in the direction Y perpendicular to the direction X. A plurality of bending parts 213 can be provided at intervals in sequence in the direction Y, and the plurality of bending parts 213 are connected with the second connecting part 2112, respectively.

Specifically, the plurality of bending parts 213 are connected between the second connecting part 2112 and the reference ground layer 31, respectively. It can be understood that through the bending part 213, the first antenna component 10 has higher degree of freedom in design and optimization, enhances antenna performance to meet different design requirements, and has higher opportunities to improve manufacturability and reduce the size of the antenna structure.

Embodiment 3

Figure 6:
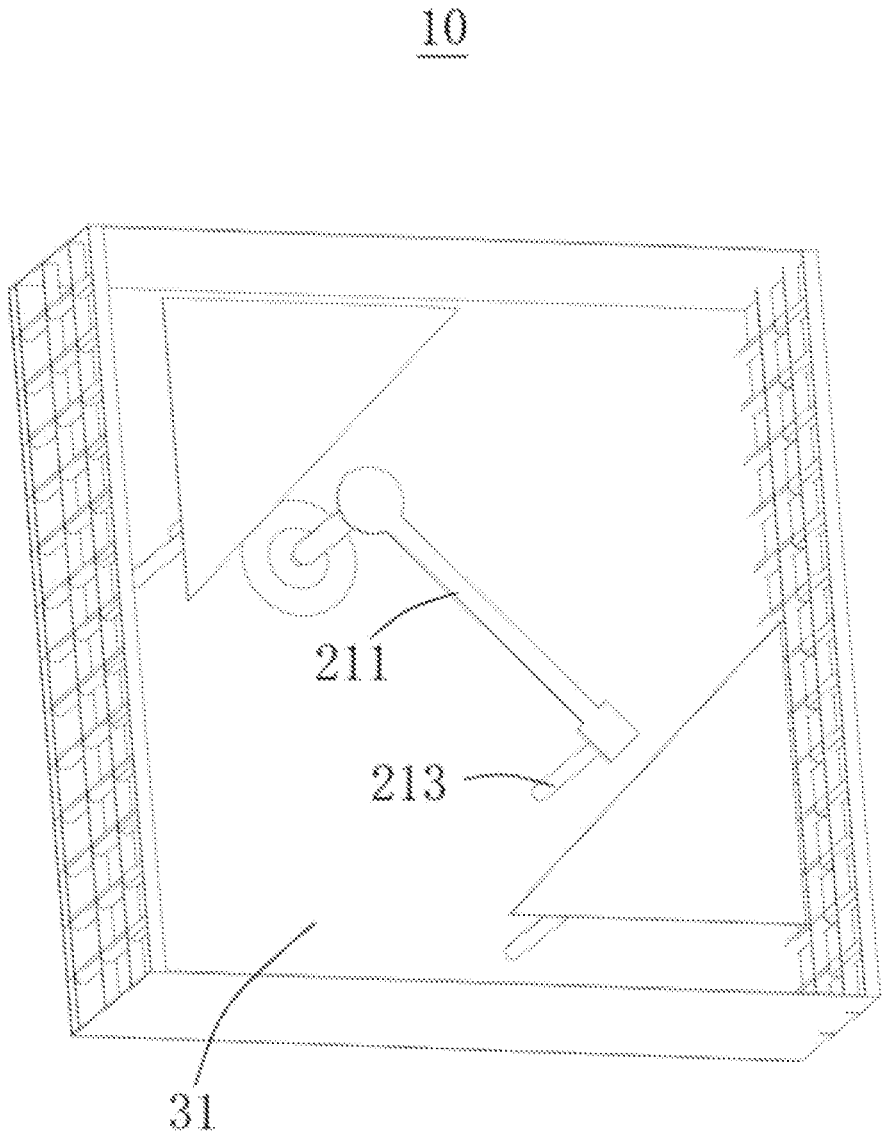
FIG. 6 is a perspective diagram of an antenna structure according to Embodiment 3 of the present disclosure with the filling medium hidden.

Refer to FIG. 6, which is a perspective diagram of an antenna structure 10 according to Embodiment 3 of the present disclosure with the filling medium hidden. The antenna structure 10 in Embodiment 3 is basically the same as the antenna structure 10 in Embodiment 1. That is, the above description of the antenna structure 10 in Embodiment 1 can be basically applicable to the antenna structure 10 in Embodiment 3. The differences between the antenna structure 10 in Embodiment 3 and the antenna structure 10 in Embodiment 1 will be mainly described hereinafter.

In Embodiment 3, the first three-dimensional antenna 21 has a bending part 213, which can be connected between the antenna main body 21 and the reference ground layer 31. It can be understood that the bending part 213 is beneficial to reducing the manufacturing complexity.

Embodiment 4

Figure 7:
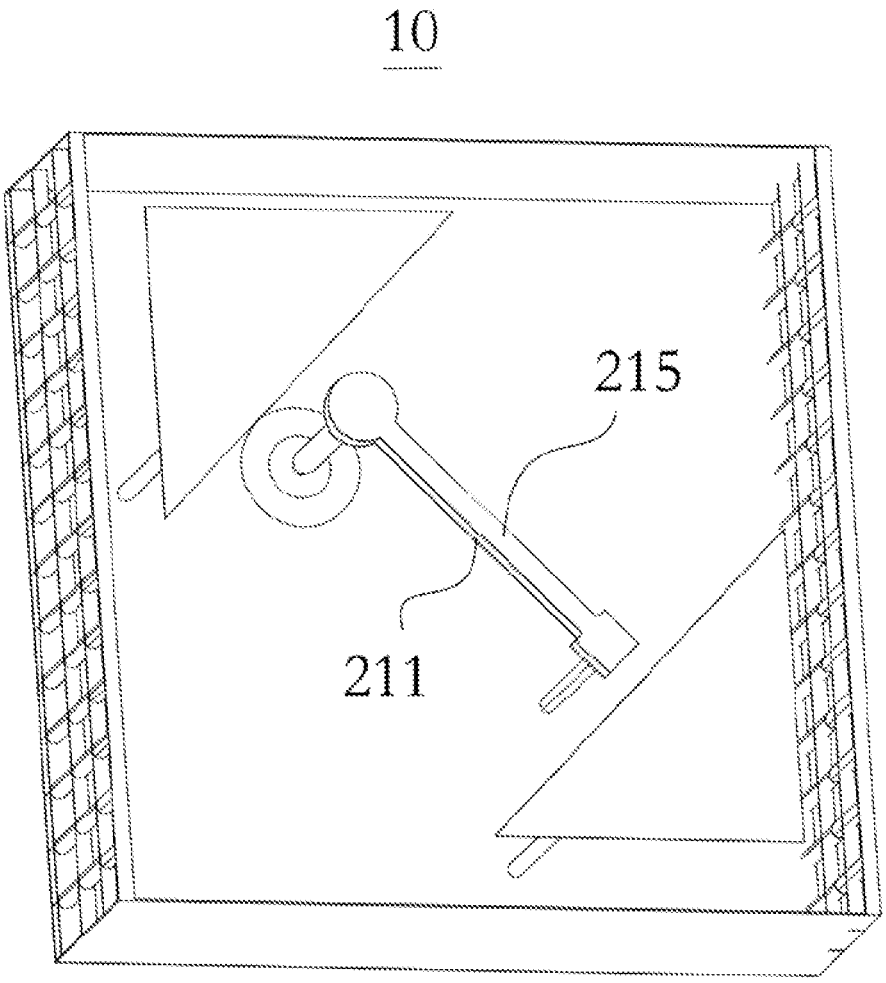
FIG. 7 is a perspective diagram of an antenna structure according to Embodiment 4 of the present disclosure with the filling medium hidden.

Refer to FIG. 7, which is a perspective diagram of an antenna structure 10 according to Embodiment 4 of the present disclosure with the filling medium hidden. The antenna structure 10 in Embodiment 4 is basically the same as the antenna structure 10 in Embodiment 1. That is, the above description of the antenna structure 10 in Embodiment 1 can be basically applicable to the antenna structure 10 in Embodiment 4. The differences between the antenna structure 10 in Embodiment 4 and the antenna structure 10 in Embodiment 1 will be mainly described hereinafter.

In Embodiment 4, the antenna structure 10 further comprises an auxiliary antenna part 215, and the auxiliary antenna part 215 and the antenna main body 211 are stacked and floated. Specifically, the auxiliary antenna part 215 is parallel to the plane where the antenna main body 211 is located, and is located directly above the antenna main body 211. A filling medium may be provided between the auxiliary antenna part 215 and the antenna main body 211. It can be understood that the auxiliary antenna part 215 can also increase the tuning freedom of the antenna structure 10, enhance the antenna performance and reduce the volume.

Embodiment 5

Figure 8:
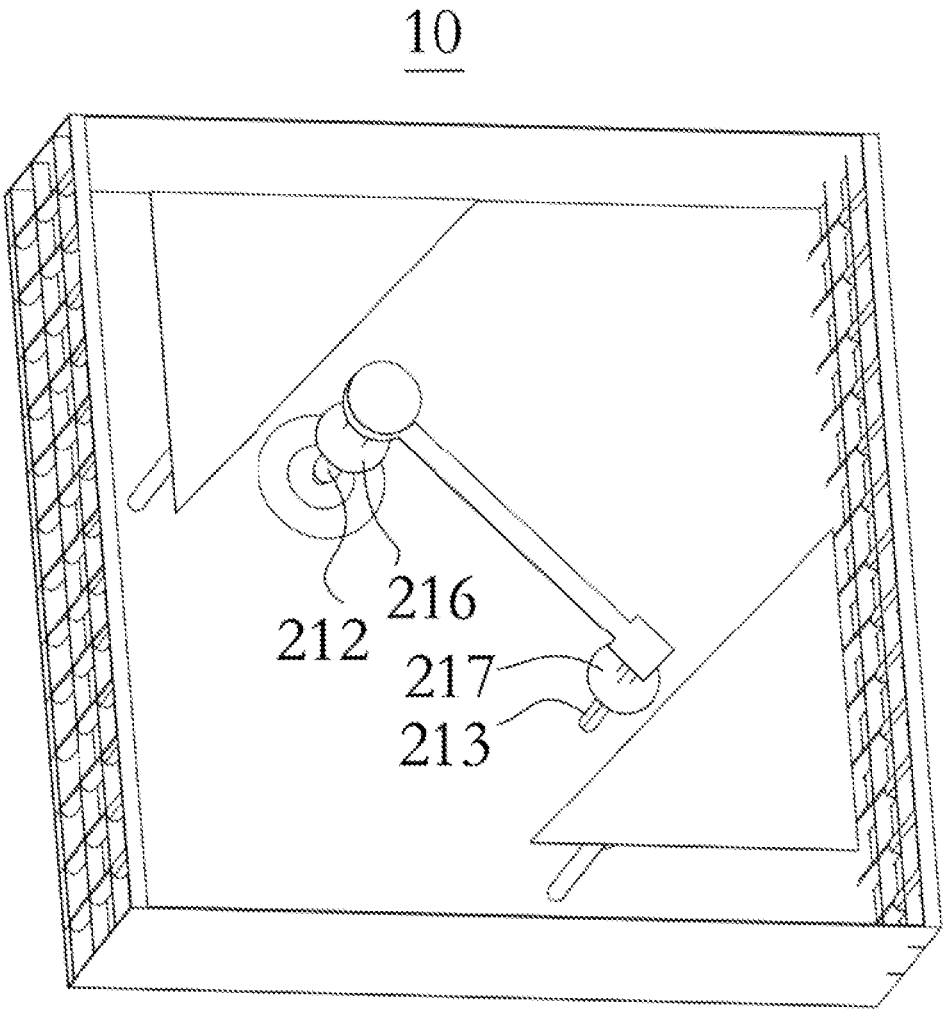
FIG. 8 is a perspective diagram of an antenna structure according to Embodiment 5 of the present disclosure with the filling medium hidden.

Refer to FIG. 8, which is a perspective diagram of an antenna structure 10 according to Embodiment 5 of the present disclosure with the filling medium hidden. The antenna structure 10 in Embodiment 5 is basically the same as the antenna structure 10 in Embodiment 1. That is, the above description of the antenna structure 10 in Embodiment 1 can be basically applicable to the antenna structure 10 in Embodiment 5. The differences between the antenna structure 10 in Embodiment 5 and the antenna structure 10 in Embodiment 1 will be mainly described hereinafter.

In Embodiment 5, the first three-dimensional antenna 21 further comprises a first extending part 216 and/or a second extending part 217, the first extending part 216 is connected with the feeding part 212 and the second extending part 217 is connected with the bending part 213. Specifically, both the first extending part 216 and the second extending part 217 can be round-cake-shaped, but not limited to round-cake-shaped. The first extending part 216 and the second extending part 217 can be provided around the periphery of the feeding part 212 and the bending part 213, respectively. The number of the first extending parts 216 and the second extending parts 217 can also be set to one or two or more according to actual needs. The first extending part 216 and/or the second extending part 217 can also increase the tuning freedom of the antenna structure 10, enhance the antenna performance, and reduce the volume.

Embodiment 6

Figure 9:
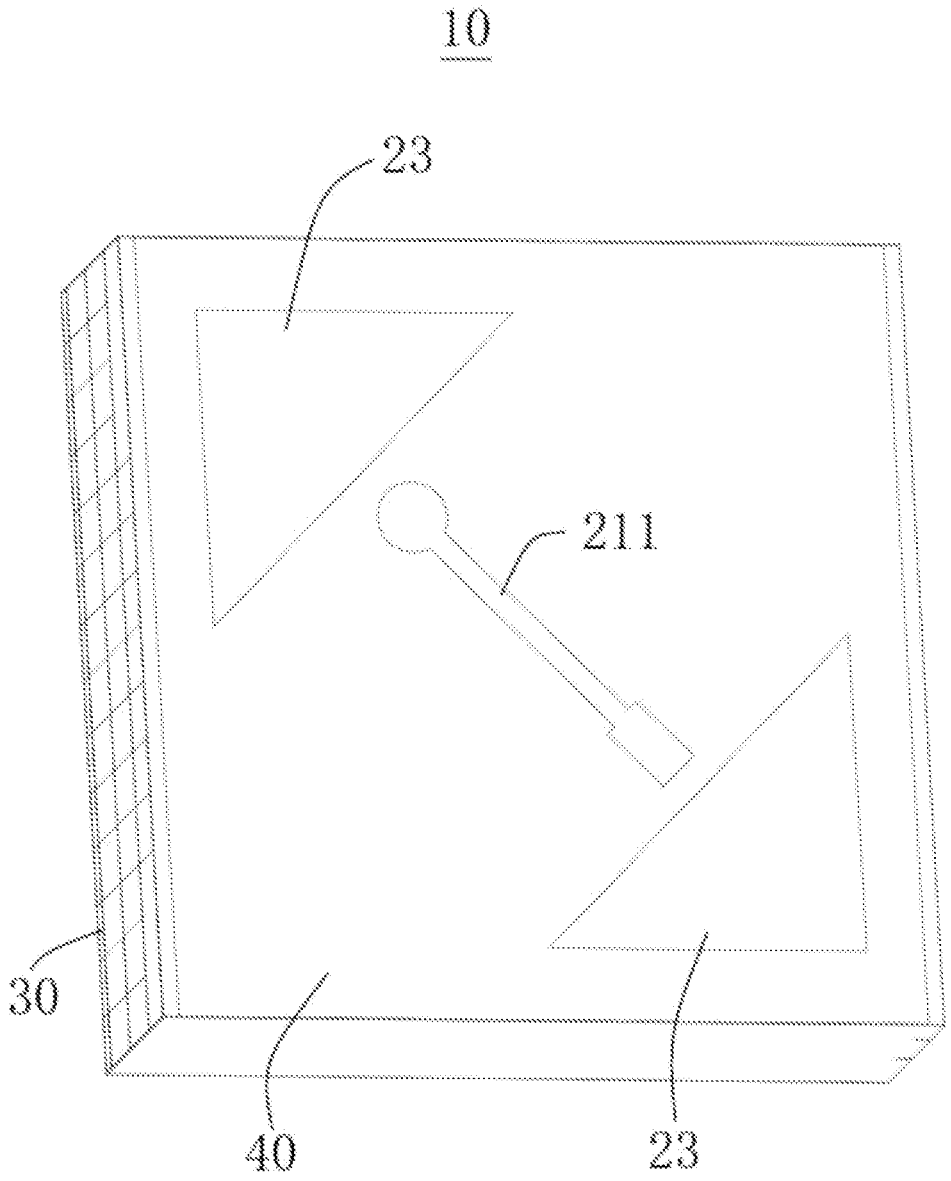
FIG. 9 is a perspective diagram of an antenna structure according to Embodiment 6 of the present disclosure with the filling medium hidden.

Refer to FIG. 9, which is a perspective diagram of an antenna structure 10 according to Embodiment 6 of the present disclosure. The antenna structure 10 in Embodiment 6 is basically the same as the antenna structure 10 in Embodiment 1. That is, the above description of the antenna structure 10 in Embodiment 1 can be basically applicable to the antenna structure 10 in Embodiment 6. The differences between the antenna structure 10 in Embodiment 6 and the antenna structure 10 in Embodiment 1 will be mainly described hereinafter.

In Embodiment 6, the antenna main body 211 and the first parasitic structure 23 are provided on the surface of the filling medium 40 far away from the carrier 30, and the filling medium 40 may not be provided with grooves. It can be understood that the above design is beneficial to reducing the manufacturing complexity.

Embodiment 7

Figure 10:
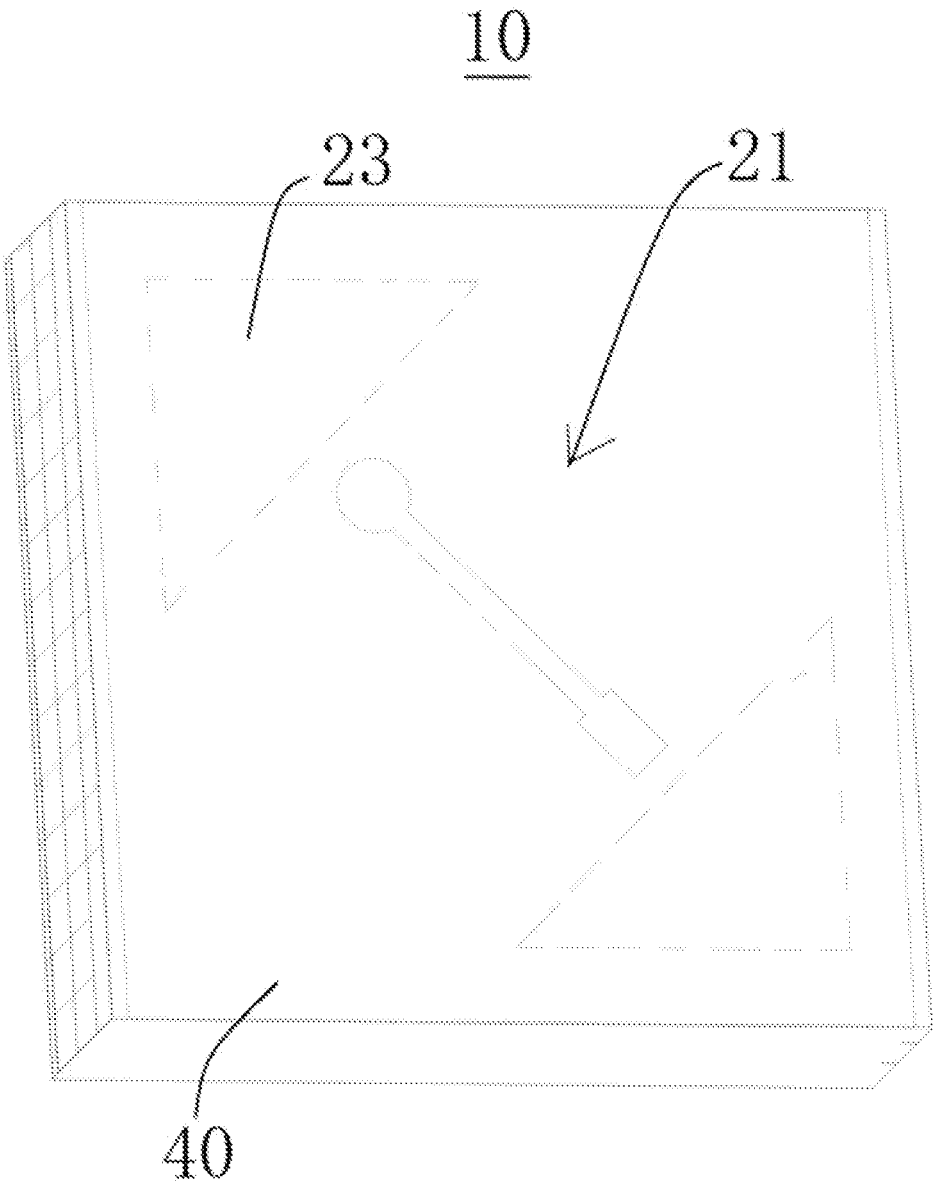
FIG. 10 is a perspective diagram of an antenna structure according to Embodiment 7 of the present disclosure with the filling medium hidden.

Refer to FIG. 10, which is a perspective diagram of an antenna structure 10 according to Embodiment 7 of the present disclosure. The antenna structure 10 in Embodiment 7 is basically the same as the antenna structure 10 in Embodiment 1. That is, the above description of the antenna structure 10 in Embodiment 1 can be basically applicable to the antenna structure 10 in Embodiment 7. The differences between the antenna structure 10 in Embodiment 7 and the antenna structure 10 in Embodiment 1 will be mainly described hereinafter.

In Embodiment 7, the first three-dimensional antenna 21 and the first parasitic structure 23 are both located in the filling medium 30. It can be understood that the above design is beneficial to reducing the manufacturing complexity. In addition, the antenna structure 10 can have higher degree of freedom in design and optimization, enhance the antenna performance to meet different design requirements, and have higher opportunities to improve manufacturability and reduce the size of the antenna structure.

Embodiment 8

Figure 11:
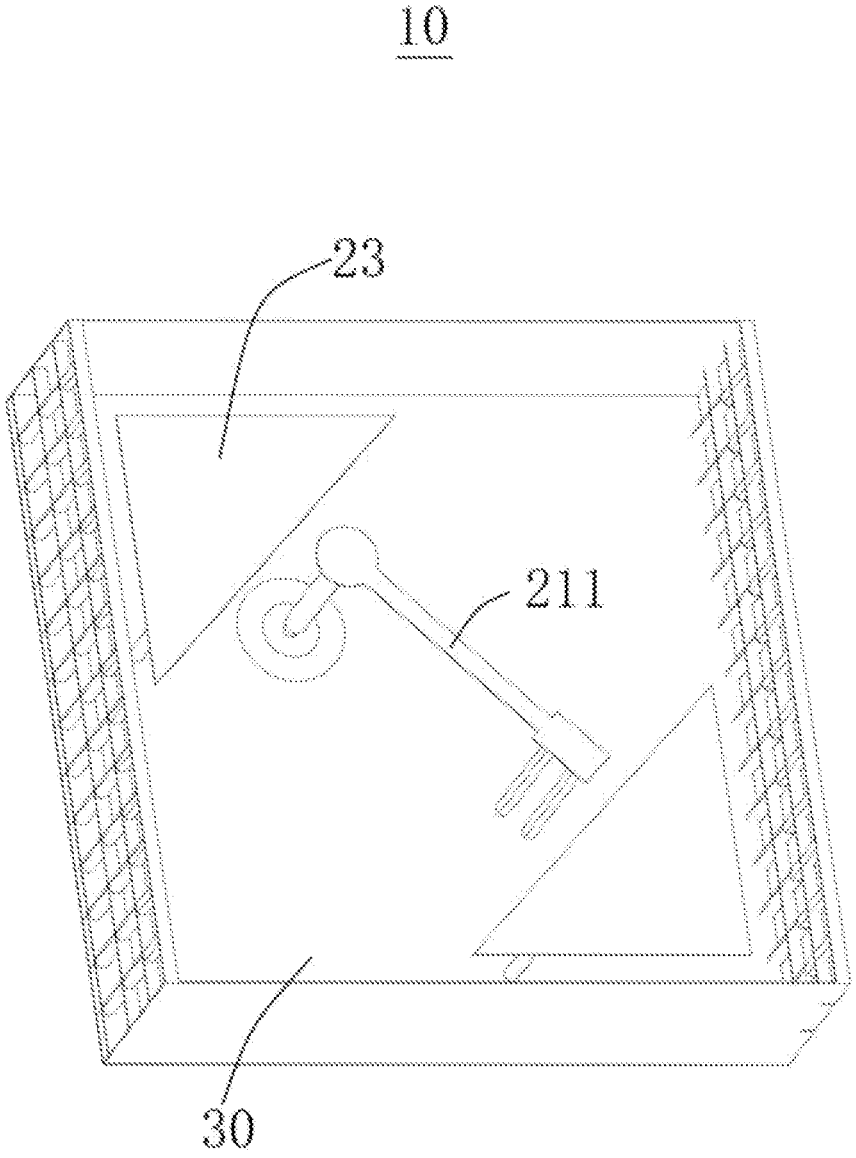
FIG. 11 is a perspective diagram of an antenna structure according to Embodiment 8 of the present disclosure with the filling medium hidden.

Refer to FIG. 11, which is a perspective diagram of an antenna structure 10 according to Embodiment 8 of the present disclosure. The antenna structure 10 in Embodiment 8 is basically the same as the antenna structure 10 in Embodiment 1. That is, the above description of the antenna structure 10 in Embodiment 1 can be basically applicable to the antenna structure 10 in Embodiment 8. The differences between the antenna structure 10 in Embodiment 8 and the antenna structure 10 in Embodiment 1 will be mainly described hereinafter.

In Embodiment 8, the antenna main body 211 and the first parasitic structure 23 may be located in different planes. Specifically, the plane where the first parasitic structure 23 is located may be parallel to the plane where the antenna main body 211 is located. The distance between the first parasitic structure 23 and the carrier 30 is different from (e.g., smaller than) the distance between the antenna main body 211 and the carrier 30. It can be understood that the above design can make the antenna structure 10 have higher degree of freedom in design and optimization, enhance antenna performance to meet different design requirements, and have higher opportunities to improve manufacturability and reduce the size of the antenna structure.

Embodiment 9

Figure 12:
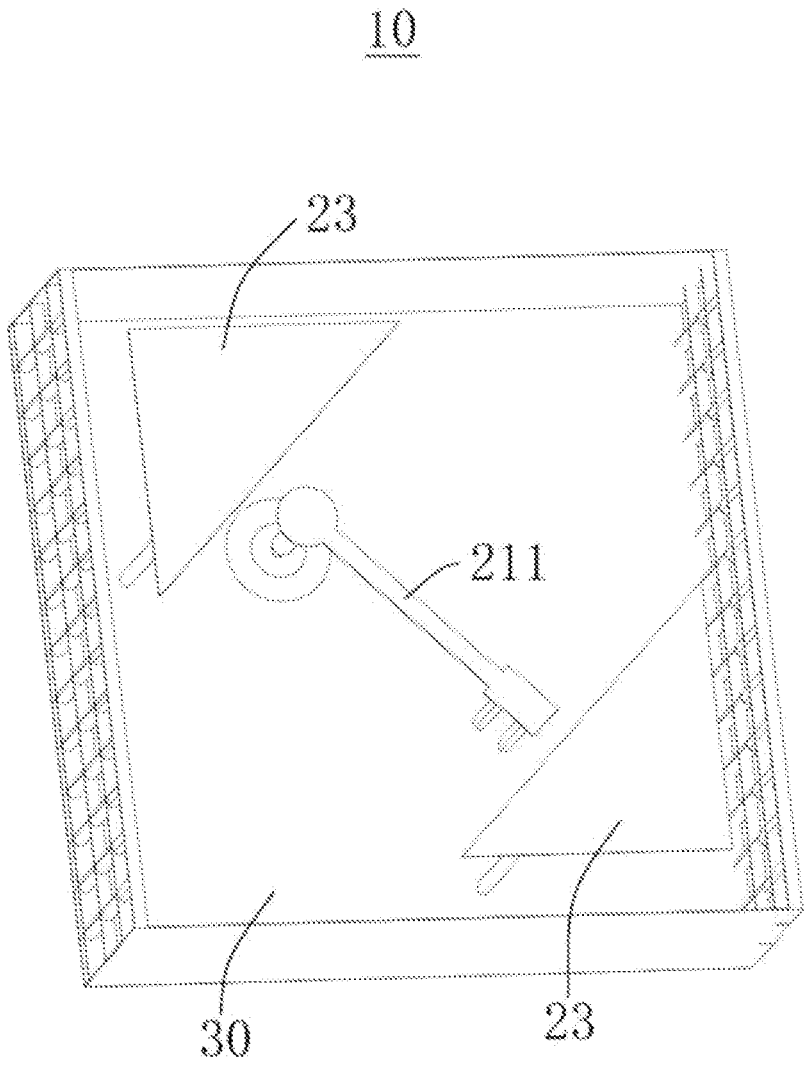
FIG. 12 is a perspective diagram of an antenna structure according to Embodiment 9 of the present disclosure with the filling medium hidden.

Refer to FIG. 12, which is a perspective diagram of an antenna structure 10 according to Embodiment 9 of the present disclosure. The antenna structure 10 in Embodiment 9 is basically the same as the antenna structure 10 in Embodiment 1. That is, the above description of the antenna structure 10 in Embodiment 1 can be basically applicable to the antenna structure 10 in Embodiment 9. The differences between the antenna structure 10 in Embodiment 9 and the antenna structure 10 in Embodiment 1 will be mainly described hereinafter.

In Embodiment 9, the antenna main body 211 and the first parasitic structure 23 may be located in different planes. Specifically, the plane where the first parasitic structure 23 is located may be parallel to the plane where the antenna main body 211 is located. The distance between the first parasitic structure 23 and the carrier 30 is different from (e.g., larger than) the distance between the antenna main body 211 and the carrier 30. It can be understood that the above design can make the antenna structure 10 have higher degree of freedom in design and optimization, enhance antenna performance to meet different design requirements, and have higher opportunities to improve manufacturability and reduce the size of the antenna structure.

Embodiment 10

Figure 13:
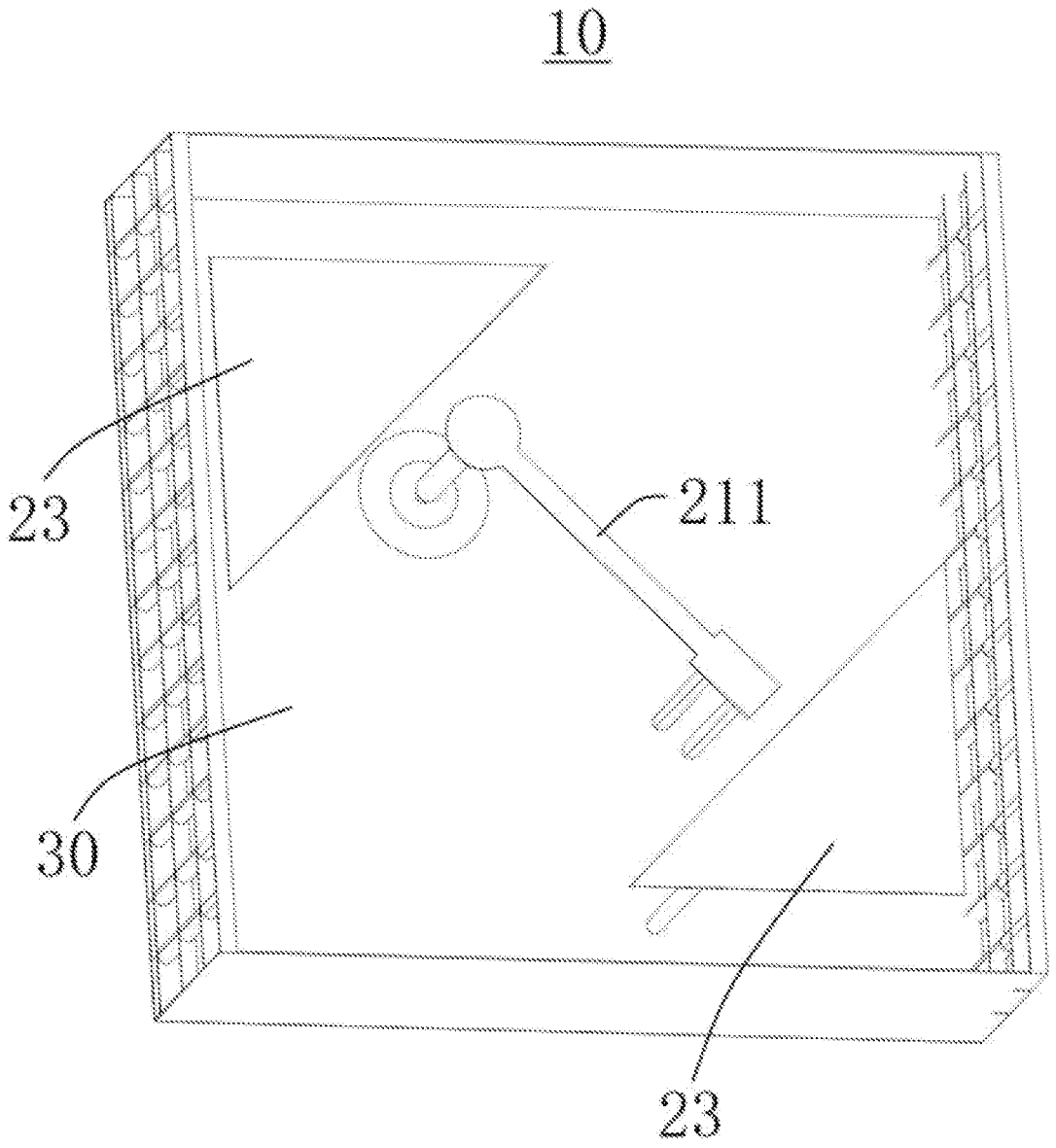
FIG. 13 is a perspective diagram of an antenna structure according to Embodiment 10 of the present disclosure with the filling medium hidden.

Refer to FIG. 13, which is a perspective diagram of an antenna structure 10 according to Embodiment 10 of the present disclosure. The antenna structure 10 in Embodiment 10 is basically the same as the antenna structure 10 in Embodiment 1. That is, the above description of the antenna structure 10 in Embodiment 1 can be basically applicable to the antenna structure 10 in Embodiment 10. The differences between the antenna structure 10 in Embodiment 10 and the antenna structure 10 in Embodiment 1 will be mainly described hereinafter.

In Embodiment 10, the antenna main body 211 and the two first parasitic structures 23 may be located in different planes. Specifically, the plane where the two first parasitic structures 23 are located may be parallel to the plane where the antenna main body 211 is located. The distance between one of the first parasitic structures 23 and the carrier 30 is smaller than the distance between the antenna main body 211 and the carrier 30, and the distance between the other of the first parasitic structures 23 and the carrier 30 is larger than the distance between the antenna main body 211 and the carrier 30. It can be understood that the above design can make the antenna structure 10 have higher degree of freedom in design and optimization, enhance antenna performance to meet different design requirements, and have higher opportunities to improve manufacturability and reduce the size of the antenna structure.

Embodiment 11

Figure 14:
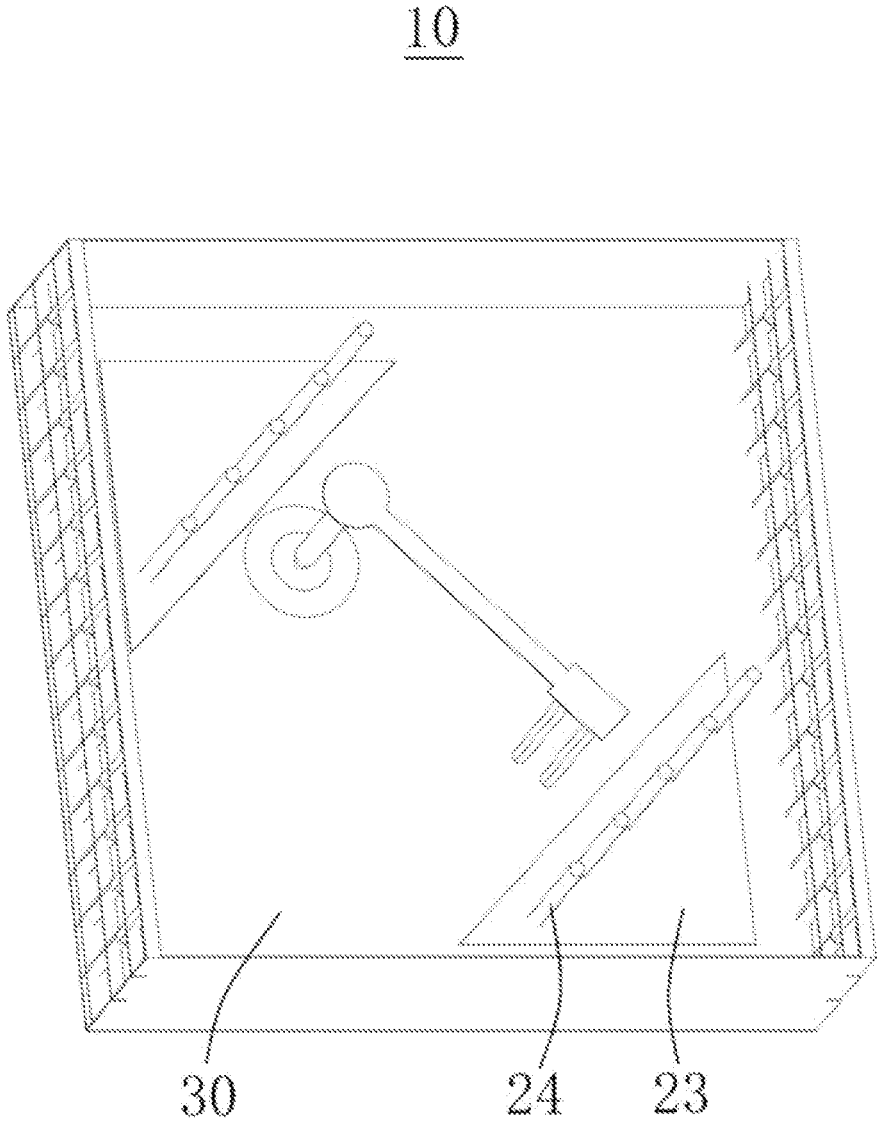
FIG. 14 is a perspective diagram of an antenna structure according to Embodiment 11 of the present disclosure with the filling medium hidden.

Refer to FIG. 14, which is a perspective diagram of an antenna structure 10 according to Embodiment 11 of the present disclosure. The antenna structure 10 in Embodiment 11 is basically the same as the antenna structure 10 in Embodiment 1. That is, the above description of the antenna structure 10 in Embodiment 1 can be basically applicable to the antenna structure 10 in Embodiment 11. The differences between the antenna structure 10 in Embodiment 11 and the antenna structure 10 in Embodiment 1 will be mainly described hereinafter.

In Embodiment 11, the antenna main body 211 and the two first parasitic structures 23 may be located in different planes. Specifically, the first parasitic structures 23 may be provided on the carrier 30, and the first parasitic structures 23 may also be connected with the parasitic connecting part 24. There may be a plurality of parasitic connecting parts 24. The plurality of parasitic connecting parts 24 are connected with the same first parasitic structure 23, respectively, and protrude from the first parasitic structure 23. It can be understood that the above design can make the antenna structure 10 have higher degree of freedom in design and optimization, enhance antenna performance to meet different design requirements, and have higher opportunities to improve manufacturability and reduce the size of the antenna structure.

Embodiment 12

Figure 15:
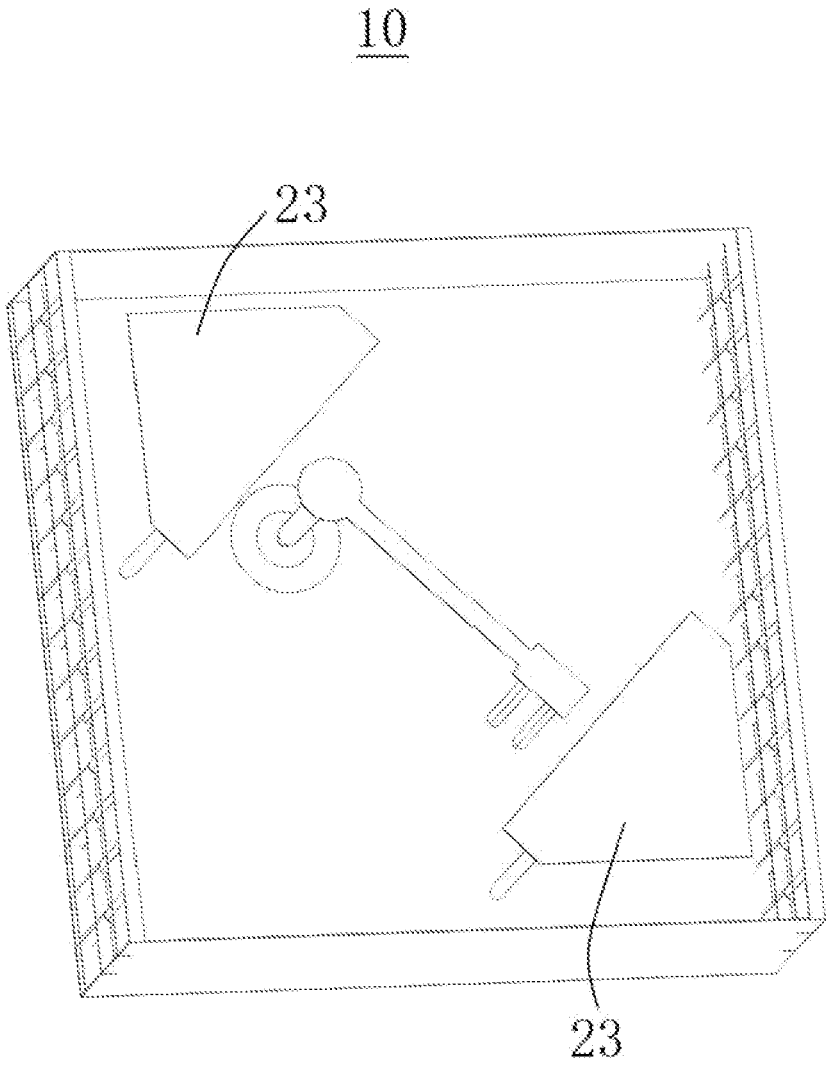
FIG. 15 is a perspective diagram of an antenna structure according to Embodiment 12 of the present disclosure with the filling medium hidden.

Refer to FIG. 15, which is a perspective diagram of an antenna structure 10 according to Embodiment 12 of the present disclosure. The antenna structure 10 in Embodiment 12 is basically the same as the antenna structure 10 in Embodiment 1. That is, the above description of the antenna structure 10 in Embodiment 1 can be basically applicable to the antenna structure 10 in Embodiment 12. The differences between the antenna structure 10 in Embodiment 12 and the antenna structure 10 in Embodiment 1 will be mainly described hereinafter.

In Embodiment 12, the shape of the first parasitic structure 23 can be cut off compared with the two ends of the isosceles triangle in Embodiment 1, so as to form a pentagon formed by aligning and connecting the lower bottoms of two identical right-angled trapezoids. It can be understood that the above design can make the antenna structure 10 have higher degree of freedom in design and optimization, enhance antenna performance to meet different design requirements, and have higher opportunities to improve manufacturability and reduce the size of the antenna structure.

Embodiment 13

Figure 16:
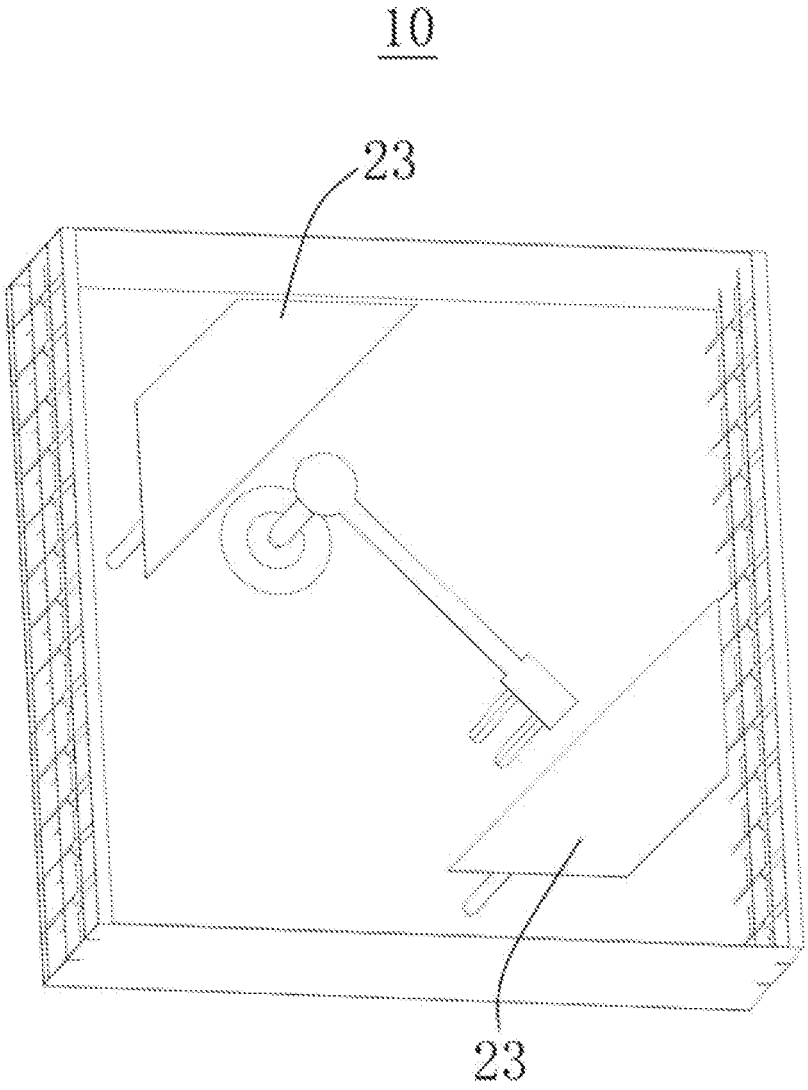
FIG. 16 is a perspective diagram of an antenna structure provided in Embodiment 13 of the present disclosure with the filling medium hidden.

Refer to FIG. 16, which is a perspective diagram of an antenna structure 10 according to Embodiment 13 of the present disclosure. The antenna structure 10 in Embodiment 13 is basically the same as the antenna structure 10 in Embodiment 1. That is, the above description of the antenna structure 10 in Embodiment 1 can be basically applicable to the antenna structure 10 in Embodiment 13. The differences between the antenna structure 10 in Embodiment 13 and the antenna structure 10 in Embodiment 1 will be mainly described hereinafter.

In Embodiment 13, the shape of the first parasitic structure 23 can be cut off compared with the vertex angle of the isosceles triangle in Embodiment 1, thereby forming an isosceles trapezoid structure. It can be understood that the above design can make the antenna structure 10 have higher degree of freedom in design and optimization, enhance antenna performance to meet different design requirements, and have higher opportunities to improve manufacturability and reduce the size of the antenna structure.

Embodiment 14

Figure 17:
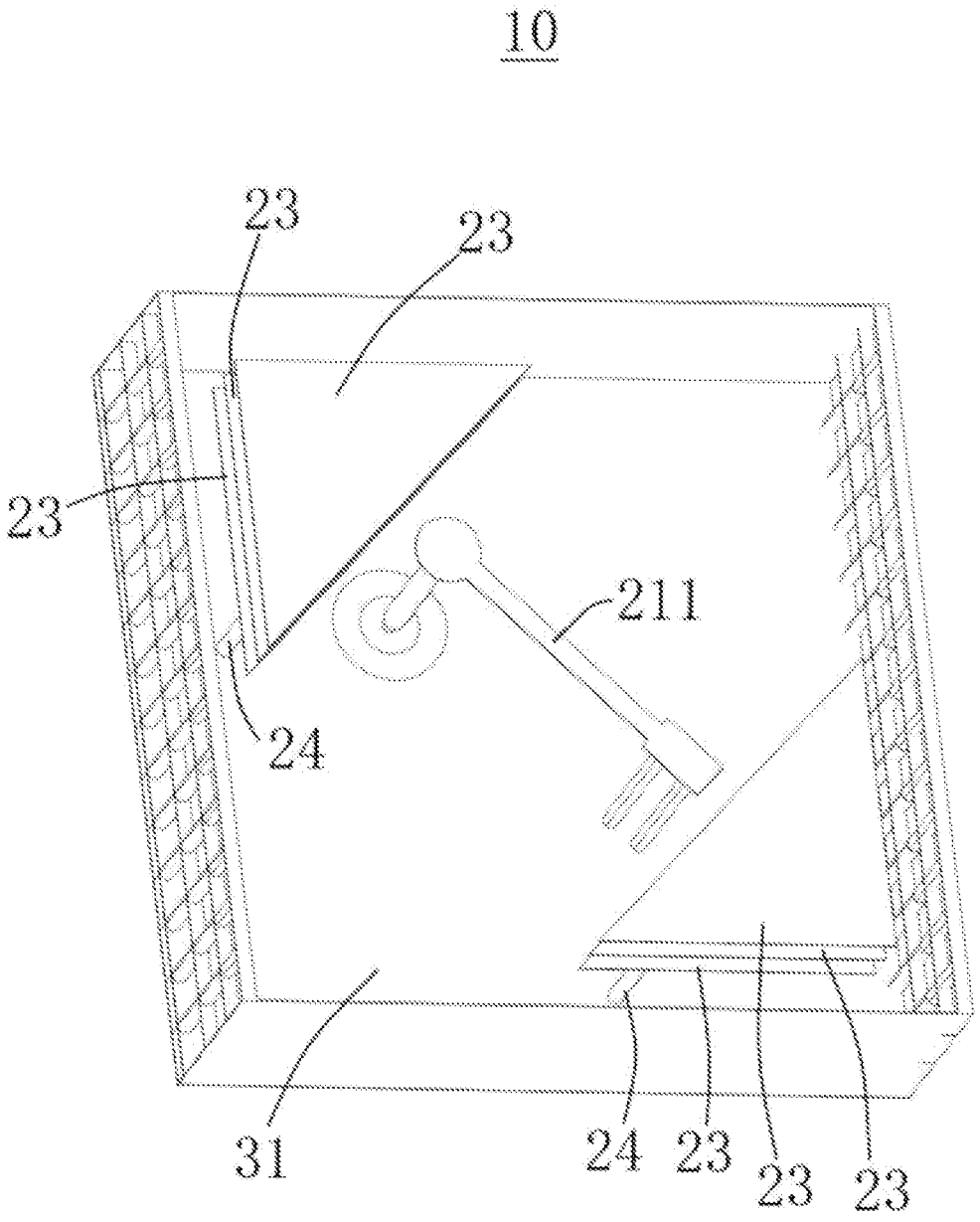
FIG. 17 is a perspective diagram of an antenna structure according to Embodiment 14 of the present disclosure with the filling medium hidden.

Refer to FIG. 17, which is a perspective diagram of an antenna structure 10 according to Embodiment 14 of the present disclosure. The antenna structure 10 in Embodiment 14 is basically the same as the antenna structure 10 in Embodiment 1. That is, the above description of the antenna structure 10 in Embodiment 1 can be basically applicable to the antenna structure 10 in Embodiment 14. The differences between the antenna structure 10 in Embodiment 14 and the antenna structure 10 in Embodiment 1 will be mainly described hereinafter.

In Embodiment 14, the number of the first parasitic structures 23 adjacent to any end of the antenna main body 211 may be at least two (such as two, three or more). At least two of the first parasitic structures 23 are arranged in sequence in the direction perpendicular to the first plane where the antenna main body 211 is located. At least two of the first parasitic structures 23 may have the same shape, be parallel to each other and be aligned. The same parasitic connecting part 24 can also be connected with at least two of the first parasitic structures 23 and connect at least two of the first parasitic structures 23 to the reference ground layer 31. It can be understood that the above design can make the antenna structure 10 have higher degree of freedom in design and optimization, enhance antenna performance to meet different design requirements, and have higher opportunities to improve manufacturability and reduce the size of the antenna structure.

Embodiment 15

Figure 18:
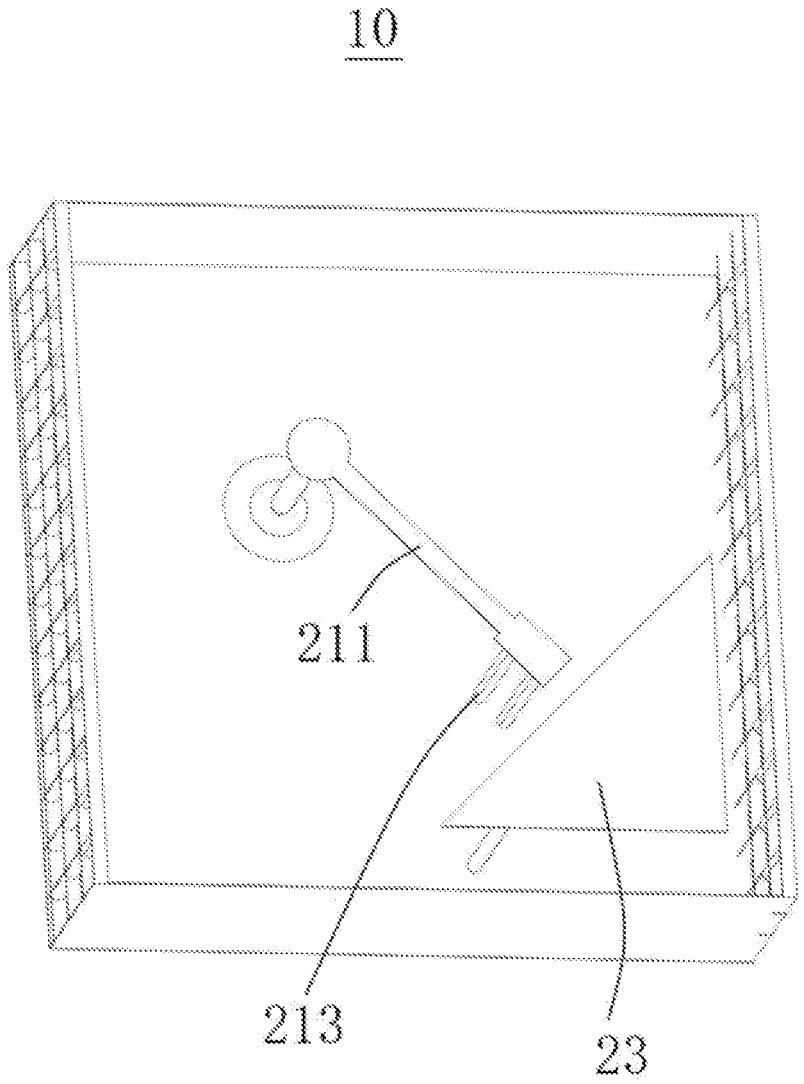
FIG. 18 is a perspective diagram of an antenna structure according to Embodiment 15 of the present disclosure with the filling medium hidden.

Refer to FIG. 18, which is a perspective diagram of an antenna structure 10 according to Embodiment 15 of the present disclosure. The antenna structure 10 in Embodiment 15 is basically the same as the antenna structure 10 in Embodiment 1. That is, the above description of the antenna structure 10 in Embodiment 1 can be basically applicable to the antenna structure 10 in Embodiment 15. The differences between the antenna structure 10 in Embodiment 15 and the antenna structure 10 in Embodiment 1 will be mainly described hereinafter.

In Embodiment 15, the number of the first parasitic structures 23 may be one, which is provided adjacent to one end of the antenna main body 211 (such as one end thereof connected with the bending part 213). It can be understood that the above design can reduce the manufacturing complexity, and make the antenna structure 10 have higher degree of freedom in design and optimization, enhance antenna performance to meet different design requirements, and have higher opportunities to improve manufacturability and reduce the size of the antenna structure.

Embodiment 16

Figure 19:
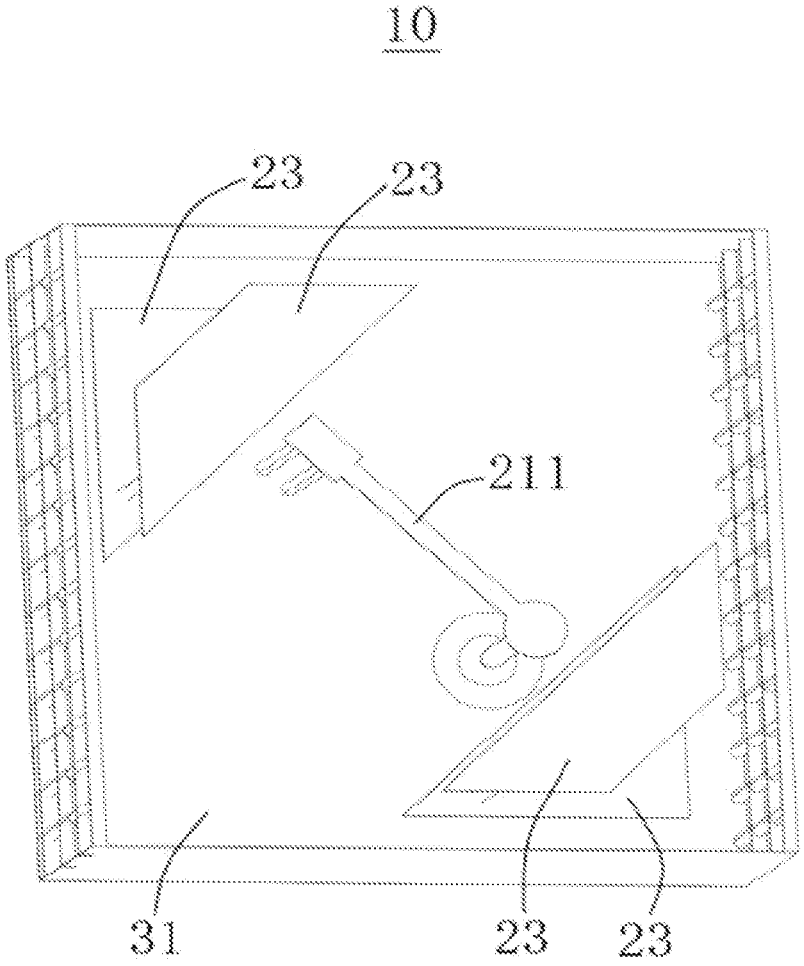
FIG. 19 is a perspective diagram of an antenna structure according to Embodiment 16 of the present disclosure with the filling medium hidden.

Refer to FIG. 19, which is a perspective diagram of an antenna structure 10 according to Embodiment 16 of the present disclosure. The antenna structure 10 in Embodiment 16 is basically the same as the antenna structure 10 in Embodiment 1. That is, the above description of the antenna structure 10 in Embodiment 1 can be basically applicable to the antenna structure 10 in Embodiment 16. The differences between the antenna structure 10 in Embodiment 16 and the antenna structure 10 in Embodiment 1 will be mainly described hereinafter.

In Embodiment 16, the number of the first parasitic structures 23 adjacent to any end of the antenna main body 211 may be at least two (such as two, three or more). At least two of the first parasitic structures 23 are provided in sequence in the direction perpendicular to the first plane where the antenna main body 211 is located. At least two of the first parasitic structures 23 may have the different shapes but be parallel to each other. The same parasitic connecting part 24 can also be connected with at least two of the first parasitic structures 23 and connect at least two of the first parasitic structures 23 to the reference ground layer 31. Specifically, among at least two of the first parasitic structures 23, one of the first parasitic structures 23 may be in the shape of an isosceles triangle, and the other of the first parasitic structures 23 may be in the shape of an isosceles trapezoid. It can be understood that the above design can make the antenna structure 10 have higher degree of freedom in design and optimization, enhance antenna performance to meet different design requirements, and have higher opportunities to improve manufacturability and reduce the size of the antenna structure.

Embodiment 17

Figure 20:
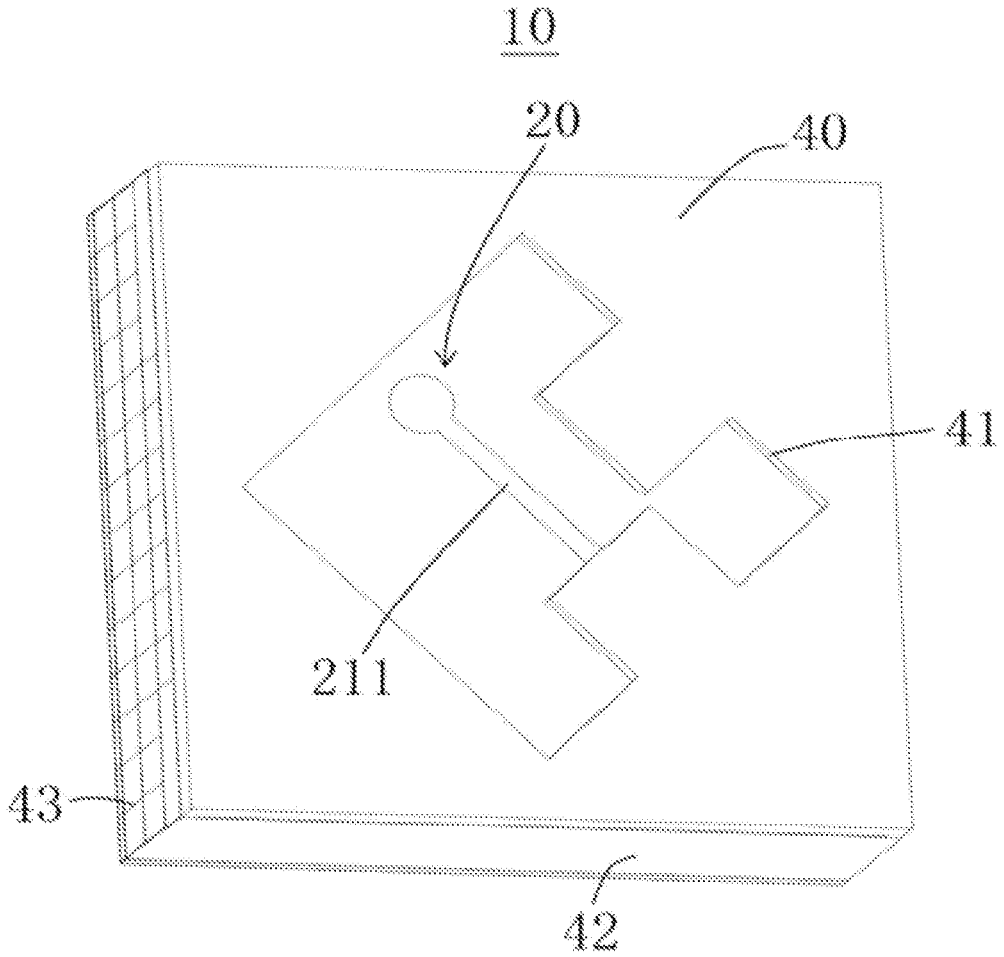
FIG. 20 is a perspective diagram of an antenna structure according to Embodiment 17 of the present disclosure.
Figure 21:
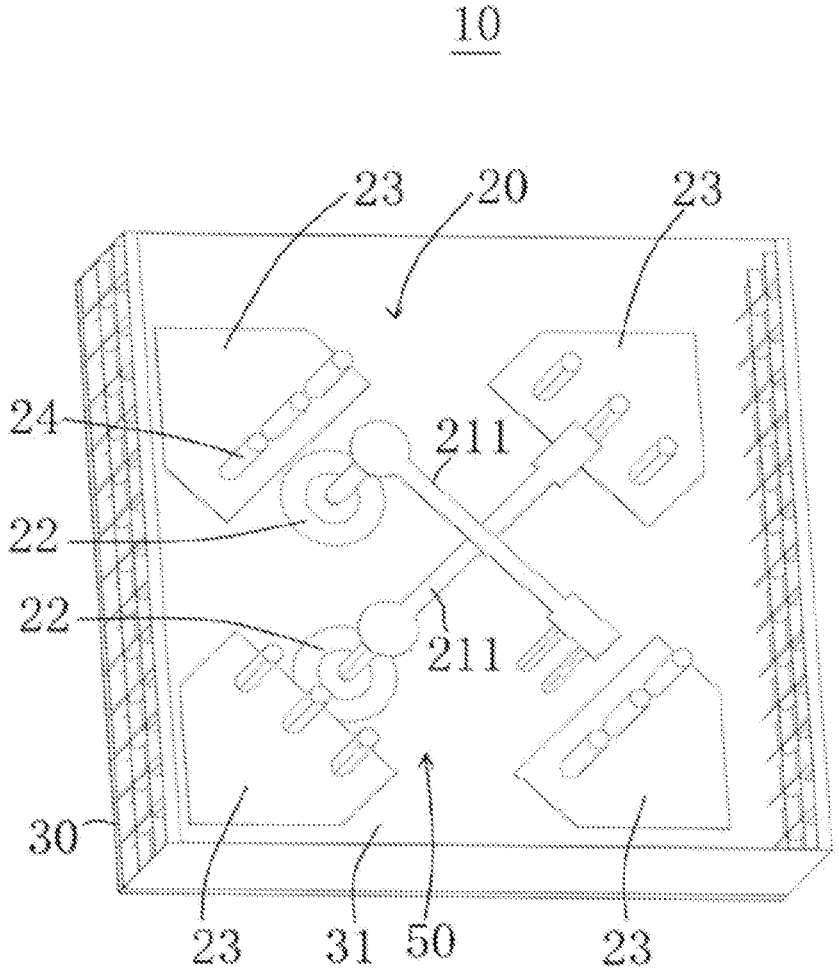
FIG. 21 is a perspective diagram of an antenna structure shown in FIG. 20 with the filling medium hidden.
Figure 22:
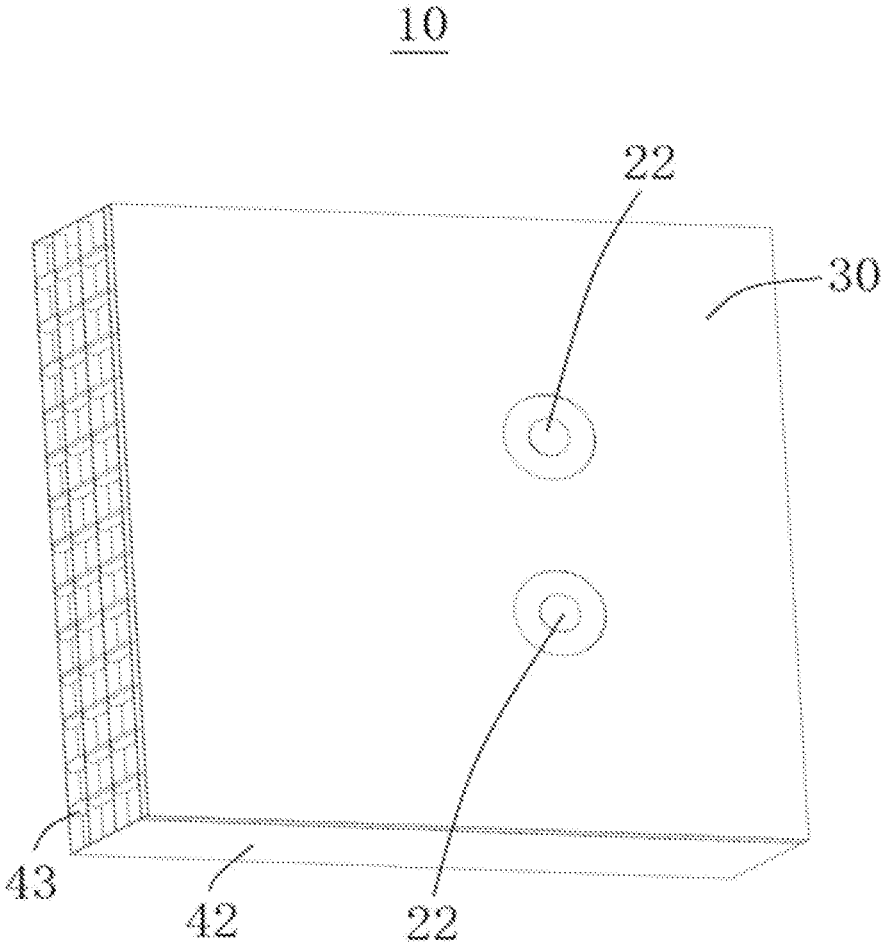
FIG. 22 is a perspective diagram of an antenna structure shown in FIG. 21 from another angle.

Refer to FIGS. 20, 21 and 22. FIG. 20 is a perspective diagram of an antenna structure 10 according to Embodiment 17 of the present disclosure, FIG. 21 is a perspective diagram of an antenna structure 10 shown in FIG. 20 with the filling medium 40 hidden, and FIG. 22 is a perspective diagram of an antenna structure 10 shown in FIG. 21 from another angle. The antenna structure 10 of Embodiment 17 is basically the same as the antenna structure 10 of Embodiment 1. That is, the above description of the antenna structure 10 of Embodiment 1 can be basically applicable to the antenna structure 10 of Embodiment 17. The differences between the antenna structure 10 in Embodiment 17 and the antenna structure 10 in Embodiment 1 will be mainly described hereinafter.

In Embodiment 17, the antenna structure 10 further comprises a second antenna component 50, which is basically the same as the first antenna component 20 in structure. That is, the description of the first antenna component 20 is basically applicable to the second antenna component 50. The antenna main body 211 of the second antenna component 50 and the antenna main body 211 of the first antenna component 20 are provided orthogonally, so that the antenna structure 10 constitutes a dual-polarized antenna structure. It can be understood that dual-polarized radiation can be formed by the first antenna component 20 and the second antenna component 50 which are orthogonally provided on the antenna main body 211, so that based on polarization diversity, the probability of the problem, e.g., disconnection of wireless connection or weak signal reception can be reduced, and the function of Multiple-Input Multiple-Output (MIMO) can be achieved, so as to enhance the transmission rate and improve user experience and product competitiveness again. It can be understood that the same structure of the first antenna component 20 and the second antenna component 50 mainly means that the components of the first antenna component 20 and the second antenna component 50 are basically the same, such as comprising the first three-dimensional antenna 21 with one end grounded, the single antenna port 22 connected with the other end of the first three-dimensional antenna 21, and the first parasitic structure 23 provided adjacent to the first three-dimensional antenna 21. The first three-dimensional antenna 21 comprises the antenna main body 211, the feeding part 212 and the bending part 213. At least part of the antenna main body 211 is located in a first plane, at least part of the feeding part 212 is located in a second plane different from the first plane, and the feeding part 212 is connected between the antenna main body 211 and the single antenna port 22. The bending part 213 is connected with one end of the antenna main body 211 far away from the feeding part 212, and at least part of the bending part 213 and the antenna main body 211 are located in different planes, and the bending part 213 is grounded.

However, the positions of the elements in the first antenna component 20 and the second antenna component 50 can be set as required. For example, the first antenna component 20 and the second antenna component 50 involved in these embodiments are orthogonally provided, which will result in different extending directions and positions of the antenna main bodies 211, but will not affect their basically identical element.

Further, the plane where the antenna main body 211 of the first antenna component 20 is located is parallel to the plane where the antenna main body 211 of the second antenna component 50 is located, and the projection of the antenna main body 211 of the first antenna component 20 intersects with the projection of the antenna main body 211 of the second antenna component 50 when viewed in the direction perpendicular to the plane where the antenna main body 211 is located; the first parasitic structure 23 of the first antenna component 20 and the first parasitic structure 23 of the second antenna component 50 are located in the same plane; or the plane where the first parasitic structure 23 of the first antenna component 20 is located is parallel to the plane where the first parasitic structure 23 of the second antenna component 50 is located. It can be understood that through the first antenna component 20 and the second antenna component 50 with the above structure, the first three-dimensional antenna of each antenna component 20 or 50 is connected with a single antenna port 22, which can not only realize dual-polarized radiation, but also reduce the number of ports required by the antenna (i.e., only based on a single port), that is, the power consumption is reduced from the antenna dimension, thereby simultaneously reducing heat generation and maintaining stable overall wireless performance. At the same time, through the first parasitic structure 23 provided adjacent to the first three-dimensional antenna of each antenna component 20 or 50, the first antenna component 20 and the second antenna component 50 can also cover multi-frequency and broadband bands (such as multi-frequency and broadband 5G millimeter wave bands), thereby significantly improving user experience and product comprehensive competitiveness.

Further, in this embodiment, the first parasitic structure 23 of the first antenna element 20 and the first parasitic structure 23 of the second antenna element 50 can be electrically connected with the ground reference layer 31. Each of the first parasitic structures 23 is connected with at least one parasitic connecting part 24, and the end of the parasitic connecting part 24 far away from the first parasitic structure 23 can be suspended and floated. It can be understood that the above design can make the antenna structure 10 have higher degree of freedom in design and optimization, enhance antenna performance to meet different design requirements, and have higher opportunities to improve manufacturability and reduce the size of the antenna structure. In addition, the filling medium 40 may cover part of the first antenna component 20 and expose its antenna main body 211. The antenna main body 211 of the first antenna component 20 may also be located in the groove 41 on the surface of the filling medium 40. The filling medium 40 may also completely cover the second antenna component 50. The outer side of the filling medium 40 may have a metal wall 42 and/or a metal fence 43. It can be understood that with regard to the reference numerals marked in FIGS. 20-22, the related elements have basically the same structure as the elements with the same reference numerals in Embodiment 1, which will not be described in detail here.

Embodiment 18

Figure 23:
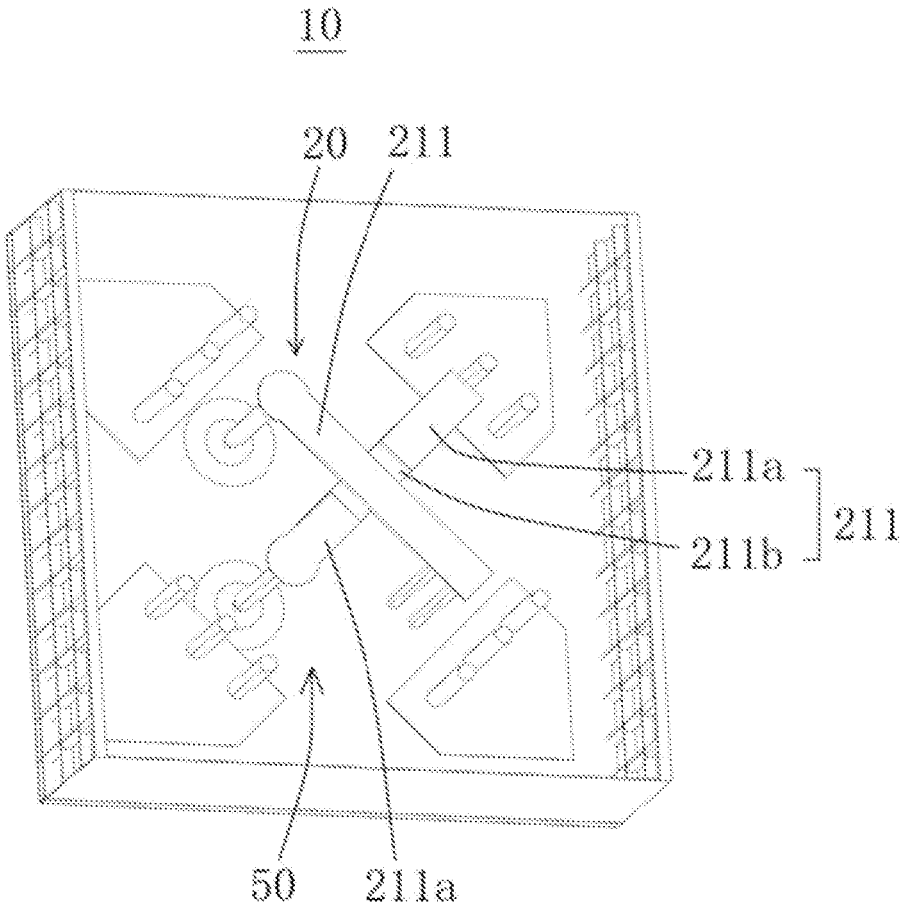
FIG. 23 is a perspective diagram of an antenna structure according to Embodiment 18 of the present disclosure with the filling medium hidden.

Refer to FIG. 23, which is a perspective diagram of an antenna structure 10 according to Embodiment 18 of the present disclosure with the filling medium 40 hidden. The antenna structure 10 of Embodiment 18 is basically the same as the antenna structure 10 of Embodiment 17. That is, the above description of the antenna structure 10 of Embodiment 17 can be basically applicable to the antenna structure 10 of Embodiment 18. The differences between the antenna structure 10 of Embodiment 18 and the antenna structure 10 of Embodiment 17 will be mainly described hereinafter.

In Embodiment 18, the antenna main body 211 of the second antenna component 50 comprises two main body parts 211*a* and a bending part 211*b*, the two main body parts 211*a* are located on the same plane as the antenna main body 211 of the first antenna component 20 and are located at two sides of the antenna main body 211 of the first antenna component 20, respectively, and the bending part 211 wraps around the outside of the antenna component 211 of the first antenna component 20 and connects the two main body parts 211*a*. It can be understood that the first antenna component 20 and the second antenna component 50 with the above structure are beneficial to achieving the antenna performance of dual-polarized radiation, thereby further improving user experience and product competitiveness.

Embodiment 19

Figure 24:
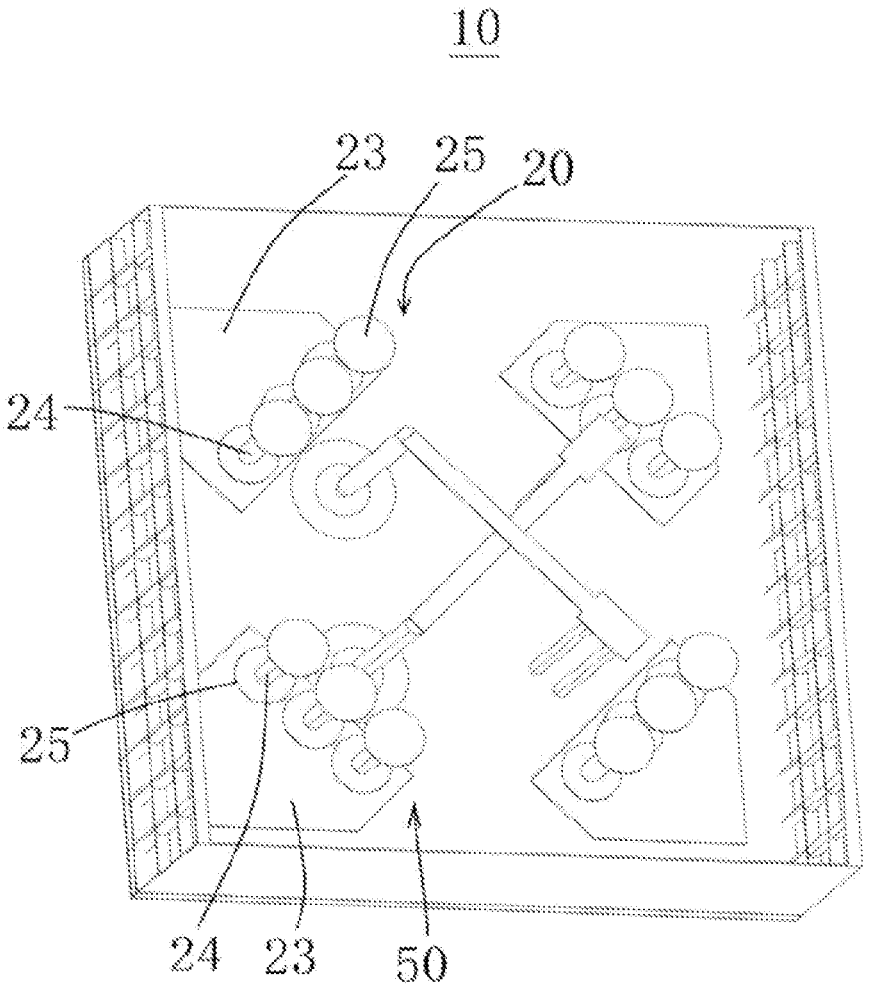
FIG. 24 is a perspective diagram of an antenna structure provided in Embodiment 19 of the present disclosure with the filling medium hidden.

Refer to FIG. 24, which is a perspective diagram of an antenna structure 10 according to Embodiment 19 of the present disclosure with the filling medium 40 hidden. The antenna structure 10 of Embodiment 19 is basically the same as the antenna structure 10 of Embodiment 17. That is, the above description of the antenna structure 10 of Embodiment 17 can be basically applicable to the antenna structure 10 of Embodiment 19. The differences between the antenna structure 10 of Embodiment 19 and the antenna structure 10 of Embodiment 17 will be mainly described hereinafter.

In Embodiment 19, both the first antenna component 20 and the second antenna component 50 comprise at least one second parasitic structure 25. The second parasitic structure is connected with the parasitic connecting part 24. The shape of the second parasitic structure 25 can be round but not limited thereto. The size of the second parasitic structure 25 can also be defined according to actual needs. Each parasitic connecting part 24 is connected with at least one second parasitic structure 25. It can be understood that through the second parasitic structure 25, the first antenna component 20 and the second antenna component 50 have higher degree of freedom in design and optimization, enhance antenna performance to meet different design requirements, and have higher opportunities to improve manufacturability and reduce the size of the antenna structure. Especially, when the second parasitic structure 25 is applied to the dual-polarized antenna structure, both the first antenna component 20 and the second antenna component 50 can have higher degree of freedom in design and optimization and enhance antenna performance to meet different design requirements.

Embodiment 20

Figure 25:
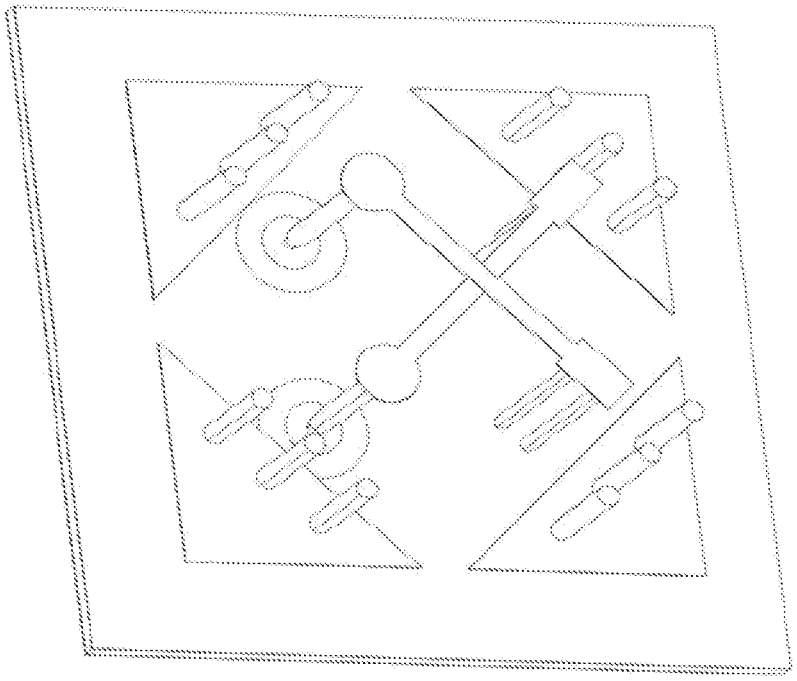
FIG. 25 is a perspective diagram of an antenna structure according to Embodiment 20 of the present disclosure.

Refer to FIG. 25, which is a perspective diagram of an antenna structure 10 according to Embodiment 20 of the present disclosure with the filling medium 40 hidden. The antenna structure 10 of Embodiment 20 is basically the same as the antenna structure 10 of Embodiment 17. That is, the above description of the antenna structure 10 of Embodiment 17 can be basically applicable to the antenna structure 10 of Embodiment 20. The differences between the antenna structure 10 of Embodiment 20 and the antenna structure 10 of Embodiment 17 will be mainly described hereinafter.

Compared with the antenna structure 10 of Embodiment 17, the antenna structure 10 of Embodiment 20 can omit the filling medium, the metal wall, the metal fence, etc. It can be understood that the above design can reduce the manufacturing complexity of the antenna structure 10 and reduce the product cost.

Figure 26:
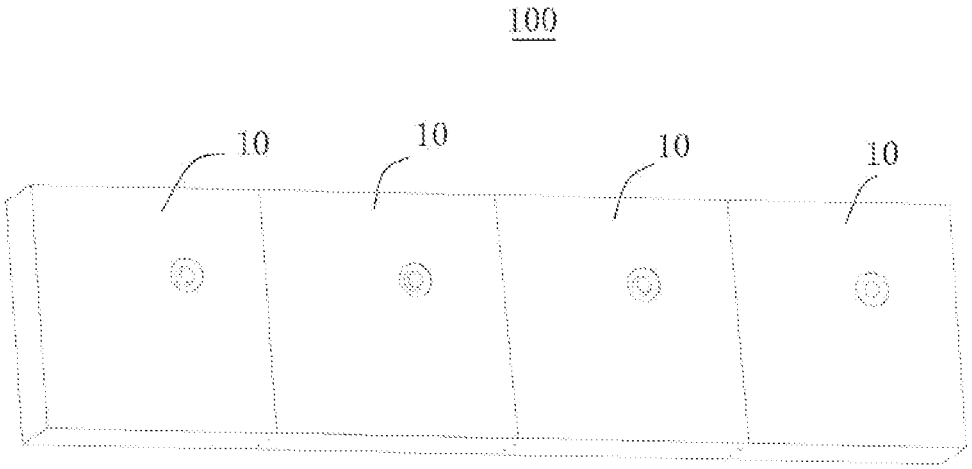
FIG. 26 is a perspective diagram of an antenna array according to an embodiment of the present disclosure.
Figure 27:
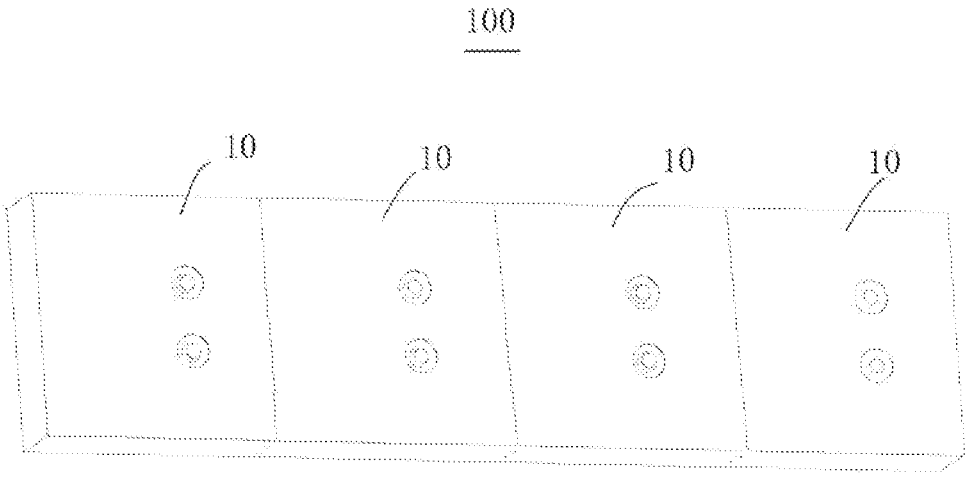
FIG. 27 is a perspective diagram of another antenna array according to an embodiment of the present disclosure.

On the second hand, as shown in FIG. 26, an embodiment of the present disclosure further provides an antenna array 100, which comprises at least two antenna structures 10 described in any one of Embodiment 1 to Embodiment 16. As shown in FIG. 27, another embodiment of the present disclosure further provides an antenna array 100, which comprises at least two antenna structures 10 described in any one of Embodiment 17 to Embodiment 20.

In the embodiment shown in FIGS. 26 and 27, the antenna array 100 comprises four antenna structures 10, which will be illustrated as an example. It can be understood that at least two of the antenna structures 10 may be provided and connected in sequence in a preset direction, wherein a metal fence (such as the metal fence 43 shown in FIGS. 1-3) may be provided in the filling medium between two adjacent antenna structures 10, or the metal fence may be omitted. A metal wall 42 may be provided on the outer surface of the filling medium of the part in which each antenna structure 10 is not connected with other antenna structures 10.

The antenna array 100 of each of the above embodiments has the beneficial effect that at least two antenna structures 10 are combined into the antenna array 100, so that better antenna gain can be obtained, so as to compensate for propagation path loss, increase the radiation distance of energy, and realize the function of beam scanning, in order to achieve wider beam coverage. Furthermore, as shown in FIG. 27, when the antenna structure 10 is a dual-polarized antenna structure, polarization mismatch of wireless transmission can be further reduced and Multiple-Input and Multiple-Output (MIMO) function can be achieved, so as to improve the data rate and achieve better user wireless experience and product competitiveness.

The antenna structure and the antenna array disclosed in the embodiment of the present disclosure has been described in detail above, and the principle and implementation of the present disclosure have been illustrated by specific examples herein. The explanation of the above embodiment is only used to help understand the antenna structure and the antenna array of the present disclosure and its core ideas. At the same time, according to the idea of the present disclosure, there will be some changes in the specific implementation and application scope for those skilled in the art. To sum up, the contents of this specification should not be construed as limiting the present disclosure.

What is claimed is:

1. An antenna structure, comprising:

a three-dimensional antenna with two ends at interval located along an extending direction, wherein one end of the two ends is grounded or connected with a reference potential, the three-dimensional antenna comprises an antenna main body, a feeding part and a bending part, wherein the antenna main body is located in a first plane, the feeding part is located in a second plane different from the first plane, the feeding part is connected between the antenna main body and a single antenna port, the bending part is connected with one end of the antenna main body far away from the feeding part, at least a part of the bending part and a part of the antenna main body are located in different planes, and the bending part is grounded;

the single antenna port being connected with another end of the two ends;

at least one parasitic structure symmetrically provided adjacent to the three-dimensional antenna, wherein the at least one parasitic structure and the two ends are arranged at interval in the extending direction, and the at least one parasitic structure is disposed independent to the three-dimensional antenna; and wherein the at least one parasitic structure comprises two triangular parasitic structures, one of the two triangular parasitic structures is adjacent to one end of the antenna main body connected with the feeding part, and the other of the two triangular parasitic structures is adjacent to the one end of the antenna main body far away from the feeding part.

2. The antenna structure according to claim 1, wherein the antenna main body comprises a first connecting part connected with the feeding part, a second connecting part connected with the bending part, and a main body part connected between the first connecting part and the second connecting part, wherein a plurality of bending parts are connected with the second connecting part, respectively.

3. The antenna structure according to claim 1, wherein the antenna structure further comprises an auxiliary antenna part, the auxiliary antenna part and the antenna main body are stacked and floated.

4. The antenna structure according to claim 1, wherein the three-dimensional antenna further comprises a first extending part and a second extending part, the first extending part is connected with the feeding part, and the second extending part is connected with the bending part.

5. The antenna structure according to claim 1, wherein the parasitic structure is located in the first plane or a plane parallel to the first plane.

6. The antenna structure according to claim 1, wherein the antenna structure comprises a carrier, the single antenna port is provided on the carrier, and the parasitic structure and the three-dimensional antenna are located on a same side of the carrier.

7. The antenna structure according to claim 6, wherein a reference ground layer is further provided on the carrier, and the parasitic structure is further electrically connected with the reference ground layer.

8. The antenna structure according to claim 6, wherein the antenna structure further comprises a filling medium provided on the carrier, at least part of the filling medium is located on the same side of the carrier as the parasitic structure and the three-dimensional antenna, at least part of the feeding part is located in the filling medium, at least part of the antenna main body is located in the filling medium or the antenna main body is located at one side of the filling medium faraway from the carrier; and at least part of the parasitic structure is located in the filling medium or at one side of the filling medium faraway from the carrier.

9. The antenna structure according to claim 8, wherein the antenna structure further comprises a metal wall provided on the outer side of the filling medium and a metal fence provided in the filling medium and adjacent to the outer side of the filling medium; or the antenna main body is located at one side of the filling medium far away from the carrier; or the surface of the filling medium far away from the carrier further comprises a groove, and the antenna main body is located in the groove.

10. An antenna array, wherein the antenna array comprises at least two antenna structures according to claim 1.

* * * * *